US005147193A

United States Patent [19]

Larsen

[11] Patent Number: 5,147,193

[45] Date of Patent: Sep. 15, 1992

[54] POWER CONVERSION MACHINE WITH PISTONS ROTATING IN PAIRS RELATIVE TO EACH OTHER IN A SPHERICAL HOUSING

[75] Inventor: Thor Larsen, Fyllingsdalen, Norway

[73] Assignee: 3D International A/S, Bergen, Norway

[21] Appl. No.: 721,474

[22] PCT Filed: Jan. 4, 1990

[86] PCT No.: PCT/NO90/00003

§ 371 Date: Jul. 3, 1991

§ 102(e) Date: Jul. 3, 1991

[87] PCT Pub. No.: WO90/07632

PCT Pub. Date: Jul. 12, 1990

[30] Foreign Application Priority Data

Jan. 9, 1989 [NO] Norway ..... 890081
Dec. 22, 1989 [NO] Norway ..... 895204

[51] Int. Cl.[5] ..... F01C 3/06; F02B 53/00

[52] U.S. Cl. ..... 418/68; 123/221; 123/241

[58] Field of Search ..... 418/68, 195; 123/221, 123/241

[56] References Cited

U.S. PATENT DOCUMENTS 168,034 9/1875 Lyon ..... 418/68
826,985 7/1906 Appel ..... 418/68
1,967,167 7/1934 Weis ..... 418/68

*Primary Examiner*—John J. Vrablik
*Attorney, Agent, or Firm*—Francis C. Hand

[57] ABSTRACT

The power conversion machine includes a housing which defines a spherical cavity as well as a stator which is secured within the housing on a first axis. The stator is provided with an annular groove which is disposed on an angle to the axis of the stator while an annular guide member is slidably mounted in the groove for rotation about the stator axis. A first rotor part is secured to a shaft which is rotatably mounted on the stator and carries a pair of pistons which define ball shaped segments within the cavity of the housing. A second rotor part having a second pair of pistons defining a pair of ball shaped segments within the cavity is disposed on a second axis perpendicular to the axis of rotation. Pins are used to secure the second rotor part to the annular guide member for rocking of the second rotor part about the second axis during rotation of the two rotor parts about the axis of rotation.

16 Claims, 10 Drawing Sheets

Figure 1:
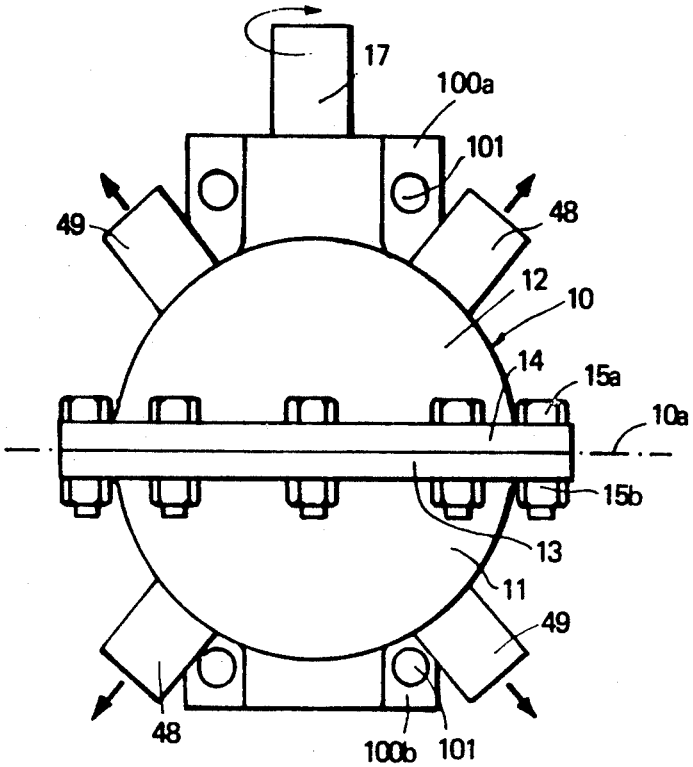

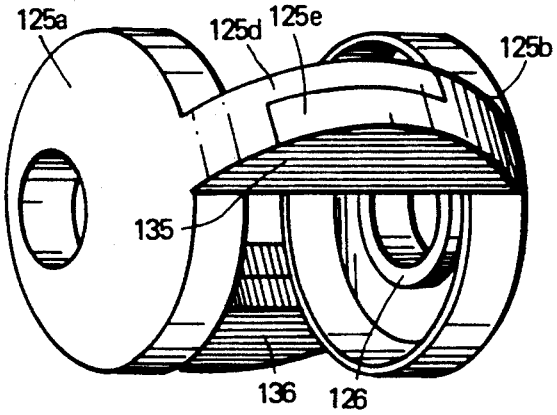
FIG.20
FIG.21
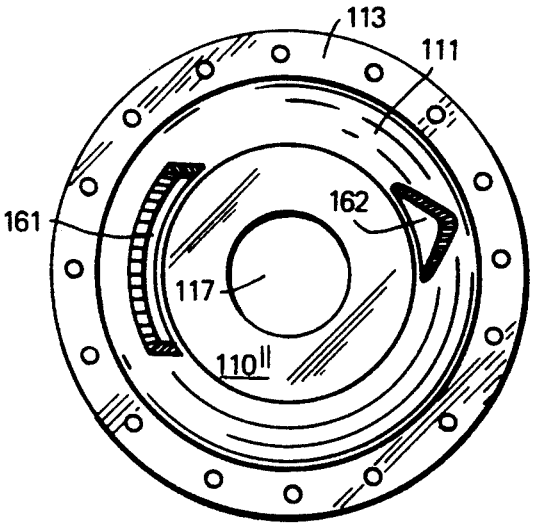
FIG.22
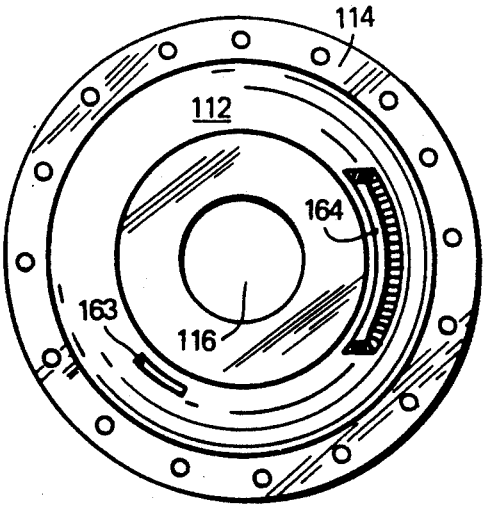
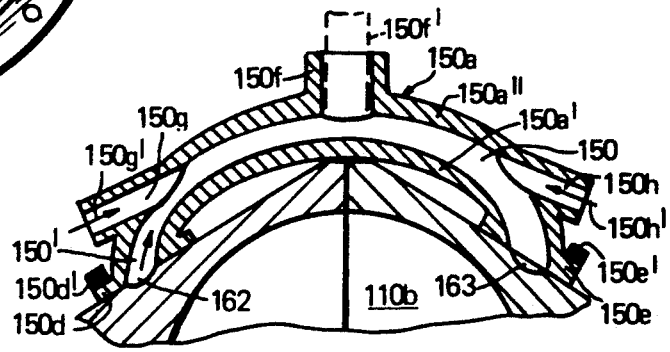
FIG.23

POWER CONVERSION MACHINE WITH PISTONS ROTATING IN PAIRS RELATIVE TO EACH OTHER IN A SPHERICAL HOUSING

The present invention relates to a power conversion machine comprising a first rotor part with a first pair of pistons and a second rotor part with a second pair of pistons adapted to be moved in a spherical cavity in the machine housing, the second pair of pistons being positively movable in a rocking movement back and forth in relation to the first pair of pistons, the first rotor part being connected to a driving or driven rotary shaft, while the second rotor part is non-rotatably connected to the first rotor part so as to perform a conjoint movement of rotation about the axis of rotation of the rotary shaft, the first rotor part being rotatable in a first path of revolution in a plane at right angles to the axis of rotation, while the second rotor part is rotatable together with and rockable in relation to the first rotor part, and the second rotor part being guided by a guide member rotatable in a second path of revolution inclined by means of stationary guide means at an angle v in relation to the first path of revolution.

The present power conversion machine may be used in various fields, e.g. as a single-stage or multistage compressor, pump, hydraulic or pneumatic engine and, respectively, as a two-stroke or four-stroke internal combustion engine etc. The machine can be employed for a large spectrum of various speeds. The machine is particularly useful as a high-speed machine, such as a high-speed compressor or high-speed engine. When the machine is in the form of a pneumatic motor, steam engine or internal combustion engine and has a moderate working volume, a speed of 500 r.p.s. (30,000 r.p.m.) can be used. When the machine is an internal combustion engine, a speed of about 100 r.p.s. (6,000 r.p.m.) can be suitable. In other cases, a speed of 50 r.p.s. can be more relevant for special other applications. In connection with propelling engines (e.g. diesel engines) for vessels, significantly lower speeds can be convenient in consideration of the speed of the propellers, and speeds of 100 r.p.m. for the propeller(s) can then be relevant also to the propelling engine. A special object is to provide a machine which effectively balances the moving masses in the machine, which results in minimal vibrations in the machine when operating. A further object is to provide a machine of a comparatively compact design with relatively few and simple parts and relatively small volume and weight in relation to its output. A still further object is to provide a machine whose working chambers are sealed from the parts of the machine which are lubricated. A further object is to provide a machine in which simple and effective guiding of the various ports in the machine housing is achieved.

U.S. Pat. No. 826,985 (D. Appel) which was granted in 1906 gives a solution of the type mentioned by way of introduction, which yields a favourable movement of the pistons and the associated working chambers relative to the various ports, based on a simple design with no crankshaft and no separately moving valves.

The prior art solution suggests the provision of a stationary guide means which is positioned radially outside the working chambers of the machine, for positively guiding the second pair of pistons in a rocking movement in relation to the first pair of pistons. There is disclosed an annular guide member which is guided in the stationary guide means in a guiding groove which is formed in the actual machine housing and which moreover extends radially beyond the actual machine housing.

According to the prior art solution, the first pair of pistons perform, in practice, a movement of rotation only, while the second pair of pistons perform a corresponding movement of rotation and, besides, an additional, positively guided rocking movement back and forth in relation to the first pair of pistons. By means of said radially outer guide means, the second pair of pistons are positively guided in a special path of movement in a stationary plane in the spherical housing, i.e. with an annular guide means inclined in a path of revolution at said angle v in relation to the path of revolution of the first pair of pistons. The rocking movement of the second pair of pistons back and forth in relation to the first pair of pistons occurs as a positively guided movement about a rocking axis extending transversely of the axis of rotation of the rotary shaft of the rotor assembly. This means that all points on the piston surfaces of the second pair of pistons are continuously rotated about the axis of rotation of the rotary shaft, at the same time as these points also perform a rocking movement back and forth in relation to the piston surfaces of the first pair of pistons. The combined movement of rotation and rocking movement of the second pair of pistons produce a favourable movement pattern for the second pistons (the second rotor part) in relation to the first pair of pistons (the first rotor part) and in relation to the enclosing machine housing with spherical inner surfaces, without the second pistons running through a dead center in the extreme positions of the rocking movement.

The result of the above-mentioned design is that the four different chambers which are defined between the four pistons, are caused to move in a corresponding movement of rotation about the axis of rotation of the rotary shaft and are pairwise connected to the stationary ports in the machine housing in fixed local areas of the paths of movement of the pistons and thus of the working chambers. In each of the cycles of rotation of the rotary shaft, two of the working chambers are subjected to an angularly uniform cubic expansion towards to a maximum, and then continuously undergo a corresponding, angularly uniform cubic reduction towards a minimum in a subsequent stroke, while the other two working chambers are correspondingly subjected to an angularly uniform cubic reduction towards a minimum and then continuously undergo an angularly uniform cubic expansion towards a maximum in a subsequent stroke. One pair of working chambers cooperate with a first pair of ports, while the second pair of working chambers cooperate with a second pair of ports. Consequently, a particularly uniform filling and uniform emptying of the working chambers are provided in a first and a second pair of working chambers in each stroke, and a change of stroke occurs immediately after the rockable pistons have reached their respective extreme position. The change of stroke does not occur via a marked movement of masses to the dead center between two pistons moving towards and away from one another, but with an even movement of masses via a positively guided movement of rotation of the pistons in relation to each other, in separate paths of movement. This movement pattern is important, as will be described below.

It is not previously known that the suggested, last-mentioned solution has proved practically useful - despite the favourable movement pattern and the favourable operating conditions to which the rotor parts are capable of being subjected. It is assumed that this is due to special problems which arise in connection with the positioning of the guide means radially outside the machine working chambers, in that the guide member (guide ring) is subjected to especially high circumferential speeds and opens to the machine working chambers, which results in operational drawbacks. It thus is a considerable drawback that the rockable pistons in each of their rocking movements must move transversely of the gap in the machine housing where the guide member (the guide ring) is mounted in the machine housing. There are great problems on the one hand of ensuring lubrication of the guide member in relation to the machine housing and, on the other hand, of establishing a seal of the guide member above the working medium in the working chambers of the machine. These problems are especially obvious in high-speed machines, particularly in high-speed internal combustion engines. It is assumed that these problems have been such that for the past 80–83 years, no solution has been found, until the present invention was made.

U.S. Pat. No. 4,938,025 and corresponding Norwegian Patent Application 882,801 discloses a power conversion machine of a similar, yet substantially different design, which eliminates some of the drawbacks of the above-mentioned prior art design, but which does not achieve all the above-mentioned objects according to the invention. In the form of a pump or compressor, the prior art solution functions efficiently, whereas in the form of an internal combustion engine it is more complicated, since a rotary crankshaft is used for moving all the pistons in a combined rocking and pivoting movement and since the valves must be specially operated in addition to the operation of the valves which is mounted in the machine housing.

According to the present invention, the problems of the two prior art solutions are solved, and a solution is provided which has considerable advantages as compared to the prior art solutions.

The machine according to the invention is characterised in that the first and the second rotor part are defined inwardly of a common spherical generatrix corresponding to a spherical inner side surface in the machine housing, and that a stationary guide means, for guiding the second rotor part in the rocking movement back and forth, is arranged centrally within the rotor assembly as an elongate stator, one end of which is rigidly connected to the machine housing.

By subjecting the two pairs of pistons to a continuous movement of rotation, while guiding the rocking movement back and forth of the second rotor part from the inner side of the rotor assembly and while providing for an effective seal of the stationary guide means and the guide member on the inner side of the rotor assembly, the pistons which are arranged on the outer side of the rotor assembly, can be moved at comparatively high speeds of motion, independently of outer guide means etc. The chosen stationary guide means which is arranged internally, and the associated, internally mounted guide member render a compact and robust design of the guide mechanism possible, which again makes it possible to move the guide member at relatively low circumferential speeds, while the radially largest circumferential portion of the rotor assembly can move at substantially higher circumferential speeds, without causing any particular problems. Besides, the guide member and the adjacent parts of the second rotor part can be balanced in a controlled manner within the rotor assembly, without causing any particular vibration in the rotor assembly or the machine as such. At the same time the working chambers can be readily sealed from the lubricant areas for the guide means and the corresponding parts inside the rotor assembly, with no risk of mixing the lubricants and the medium which is processed in the working chambers of the machine.

According to the invention, an effective solution is readily achieved, especially for a high speed machine as stated by way of introduction, by defining, as mentioned above, the rotor parts inwardly of a spherical generatrix corresponding to a spherical inner side surface in the machine housing and by moving the stationary guide means from a radially outer position to a centrally inner position. This brings the considerable advantage that the ports can be formed in optional positions inside in the spherical surface of the machine housing, independently of the position of the guide means. A special advantage is that the outside of the rotor assembly and the inside of the motor housing can both be designed with spherical surfaces which can be adapted exactly to each other for rotation of the rotor assembly at particularly high speeds of rotation. In this context, it is of great importance that the stationary guide means and the guide member are arranged radially inside the rotor assembly.

Provision is made for the guide means to be arranged coaxially with the rotary shaft and extending through the machine housing from a bearing connected with the inner end of the rotary shaft, to a stationary mounting in the opposite end of the machine housing.

As a result, the rotor assembly is effectively mounted on the stationary guide means, at the same time as the guide member (guide ring) of the second rotor part can be effectively guided on the stationary guide means which is defined within the rotor assembly.

The stationary guide means extends centrally through the first rotor part, in that the first rotor part is rotatably mounted relative to the guide means at the opposite ends thereof. Thus, also the rotor assembly can be readily mounted in the machine housing.

As mentioned above, the present invention aims at avoiding any communication whatsoever between the lubricants (which are to lubricate especially the bearing surfaces between the guide member and the stationary guide means, the bearing surfaces between the first rotor part and the stationary guide means, and the bearing surfaces between the second rotor part and the guide member) and the working medium (which is processed in the working chambers of the machine).

According to the invention, it is possible to ensure an effective, common seal of the internal bearing means of the rotor assembly and the bearing means of the internally arranged guide member, such that they can be lubricated by means of a common lubricant system arranged in the form of channels in the stator of the machine. Therefore, the inventive machine is characterised in that the first rotor part is passed endwise through the second rotor part through an annular, radially outer rotor part portion, in that the first and the second rotor part jointly define a cavity which contains lubricants and is sealed against the working chambers, said cavity enclosing the stationary guide means and the associated guide member as well as the connecting means of the guide member, which connects with the second rotor part.

The various solutions according to the invention (in the same manner as according to US Patent 826,985) do not generally necessitate valve-operated ports, since the movements of the pistons can operate the opening (uncovering) and the closing (covering) of the ports merely by means of their movement of rotation relative to the ports in the spherical housing. The point of time for opening (uncovering) and closing (covering) of the ports can be regulated by a corresponding optional design of and corresponding positioning of the ports in the spherical housing, independently of outer stationary guide means and outer guide member. Use can be made of two intake ports and two exhaust ports, i.e. one intake port and one exhaust port which are common to a first pair of working chambers, while a further intake port and a further exhaust port are common to a second pair of working chambers.

A practically favourable solution which in constructional respect is simple, implies that the first and the second pair of pistons, together with the rotary shaft, constitute a rotor assembly, while the spherical housing and a guide means attached thereto, for guiding the second pair of pistons in the second guide path, constitute a stator assembly.

Use can here be made of but a small number of separate parts both in the rotor assembly and in the stator, at the same time as a simple and relatively compact constructional solution is provided, with low weight and comparatively small volume but with a relatively high output. More precisely, the stator comprises the guide means and the machine housing which are rigidly connected to each other, while the rotor assembly comprises the first rotor part, the second rotor part and connecting means attached thereto and hingedly connected to the guide member by a pair of pivot pins, said guide member being rotatably mounted on the stationary guide means. In consideration of assembly and production, the parts are, in practice, divided into a large number of parts, but roughly seen the stator consists of a single part, whereas the rotor assembly comprises three cooperating parts (the two rotor parts and the guide member). In addition, the various parts can be readily manufactured and mounted in a relatively simple manner, as will appear from the description below.

In a preferred solution according to the invention, the machine housing is, at each of its opposing ends, provided with a pair of ports which, in respect of the angle of rotation, are spaced apart and located inwardly of the paths of movement of the peripheral edges of the spherical outer surface of a respective end portion of the first rotor part, said ports being adapted to be covered and uncovered by said end portions in the various positions or areas of rotation of the rotor assembly, in that the spherical outer surface which is defined on the end portions of the first rotor part and which is symmetrical relative to the axis of rotation of the rotor assembly, is of a length which is significantly larger than the width.

This means that according to the invention it is possible to guide the ports in their entirety by means of the piston-forming end portions of the first rotor part.

According to the invention, it is possible, by using the machine as a compressor or pump or as a two-stroke internal combustion engine, to ensure that two diametrically opposite working chambers are connected to mutually diametrically opposite ports constituting intake ports (and are then connected to mutually adjoining ports constituting exhaust ports), while two other mutually diametrically opposite working chambers are at the same time connected to the corresponding, mutually diametrically opposite ports constituting exhaust ports in the respective fixed phases of the respective strokes (and are then connected to mutually adjoining ports which constitute exhaust ports).

When the machine is in the form of a four-stroke internal combustion engine, the cavity of the motor housing defines, by means of the rotor assembly, four separate working chambers which separately and, in turn, pairwise are subjected to the respective two of the four strokes of the engine in communication with the respective two of the four ports, of which at the same time a first port constitutes an air intake port to a first working chamber, and a second port constitutes an exhaust port for compressed air from a second working chamber to a connecting chamber arranged radially outside the working chambers, a third port constitutes an intake port from the connecting chamber to a third working chamber forming an expansion chamber, while a fourth port constitutes an exhaust port from a fourth working chamber to an exhaust outlet.

According to the invention, it can first be achieved that the connecting chamber connects one pair of working chambers operating on the suction/compression side, to a second pair of working chambers operating on the combustion/exhaust side of the machine housing. Secondly, it can be achieved that the connecting chamber which preferably is arranged outside the cooling casing of the engine, can also constitute an external combustion chamber with nozzle(s) and igniting means.

By combining the external connecting chamber with an external combustion chamber, a number of considerable advantages can be obtained.

First, it is possible to simultaneously ensure that each of the four strokes (suction, compression, combustion and exhaust) occurs in one and the same engine housing but each separately in one of the four working chambers.

Secondly, it is possible to obtain a considerable simplification of the actual combustion process, a considerable simplification of the heat loss, a high combustion temperature and, as a consequence, a complete combustion of the fuel etc.

Therefore, the combustion chamber is preferably provided with a layer of internally heat-insulating, ceramic material.

This brings several considerable advantages.

First, the combustion in the combustion stroke of the engine can occur outside the working chambers, such that the parts of the rotor assembly can be held on a low thermal level, while the combustion chamber can be held on a significantly higher thermal level, which can ensure effective combustion independently of the internal parts of the engine (the inner side of the machine housing, rotor assembly etc.).

More precisely, the combustion chamber can be attached in a stationary manner to the engine housing itself, preferably outside both the engine housing itself and the water casing of the engine, and independently of the engine rotor assembly, water casing, lubricant system etc. Correspondingly, the rotor assembly of the engine can be designed in a manner which is as favourable as possible in respect of rotation, independently of the actual combustion cycle and the design of the combustion chamber.

Moreover, the working chambers with which the combustion chamber shall interact, can be subjected to continuous rotation relative to the port which supplies the working medium from the stationary combustion chamber, such that also the kinetic energy of the hot gas flow in the direction of movement of the working chambers can be efficiently utilised.

A further essential advantage of attaching the combustion chamber in a stationary manner outside the engine housing, is that one can obtain effective combustion of the fuel at an especially high and at the same time relatively even level of temperature, more or less independently of the temperature conditions inside the engine housing. The combustion chamber can readily be defined inwardly of an area which is comparatively easily heat insulated and easily made resistant to high temperatures (for example by lining the inner walls and, optionally, the outer walls with ceramic materials), such that the combustion chamber can be kept at a high constant level of temperature, thereby to ensure an effective, more or less complete combustion of the fuel. This results in both environmental advantages and a higher output of the engine. In other words, the supply of heat locally to the external combustion chamber of the engine housing can be limited, and the supply of heat can to a large extent be restricted to this local area of the engine. For the same reason, a slightly lower level of temperature can correspondingly be obtained inside the engine housing, such that the rotary parts of the engine can be kept at relatively low levels of temperature which are easily controllable in a corresponding manner, by using ordinary external water or air cooling of the engine housing and ordinary internal oil cooling of the rotor assembly and its stationary guide means and the associated guide member.

A further advantage is that the hot fuel gas can be supplied at high pressure directly to the different working chambers via a single port whose opening area is accurately defined and for which the time for opening and closing is precisely set in relation to the cycle of rotation. In practice, the flow of hot compressed gas can be approximately fully continuous in a rapidly pulsating gas flow from the combustion chamber to the immediately following working chambers, without ordinary valve operation and exclusively controlled by the movements of rotation of the rotor assembly.

By avoiding valve operation, cam shafts etc., one obtains considerable advantages. For example, it is possible to easily use large ports for taking in air and, respectively, letting out exhaust gas, thereby to ensure that air is taken in correspondingly quickly and relatively freely and that exhaust gas is blown out quickly, with no need for additional, moving parts, which is particularly favourable in high-speed engines. Accordingly, one can easily design the various ports with a cross-sectional shape and area which are fully determined by the intended way of flowing of the gas medium in the different strokes in the engine housing and in the combustion chamber, respectively.

Figure 2:
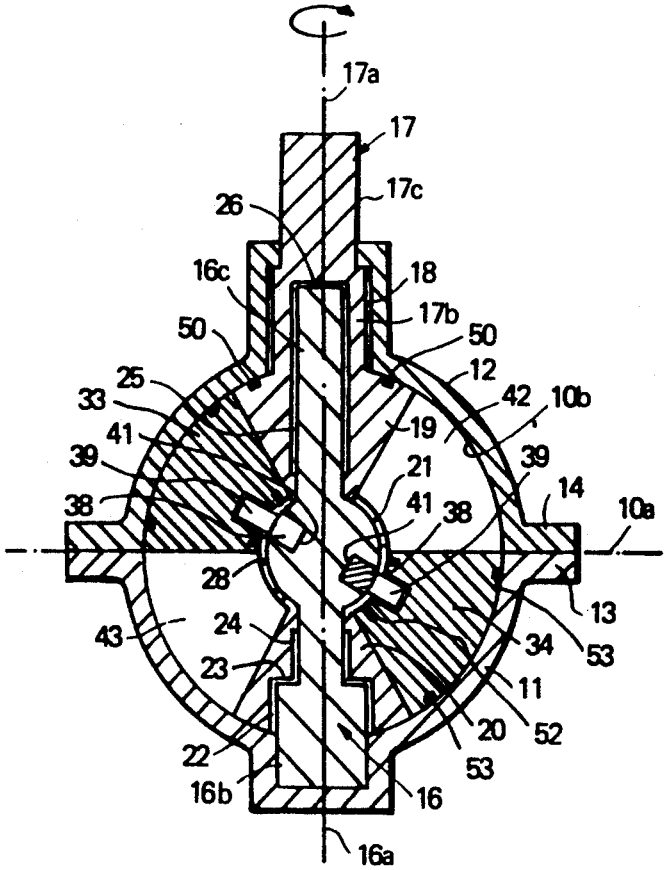
Figure 3:
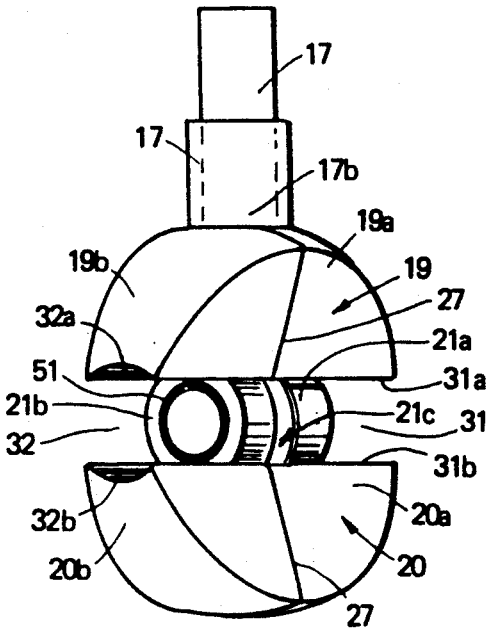
Figure 4:
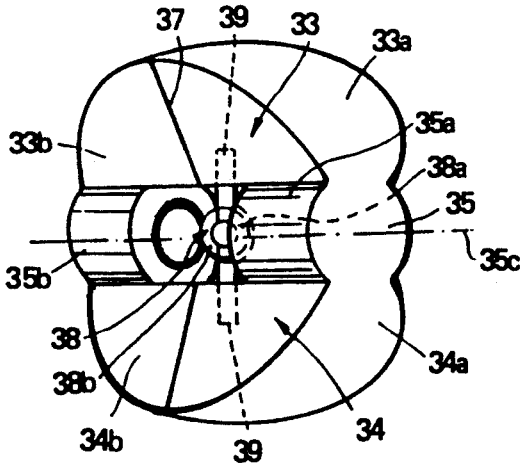
Figure 4A:
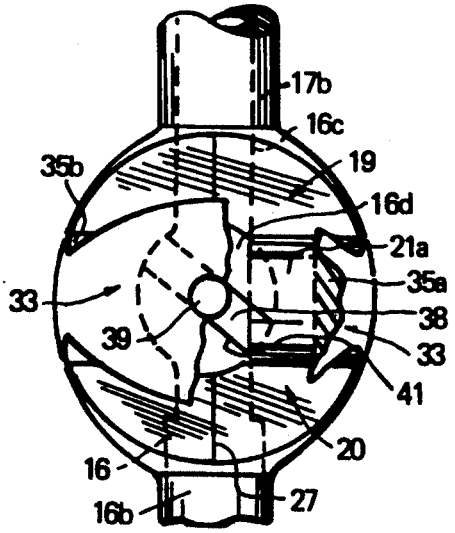
Figure 5:
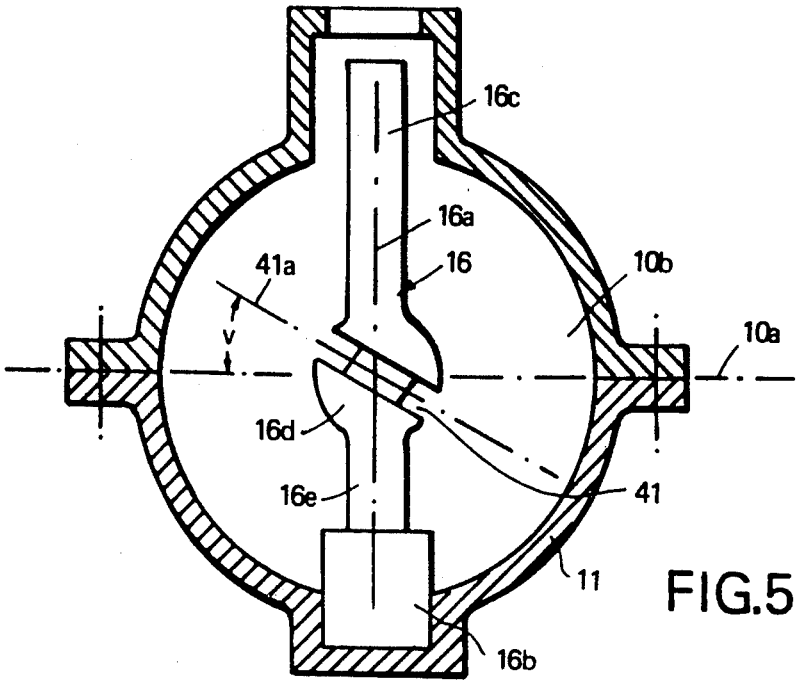
Figure 6:
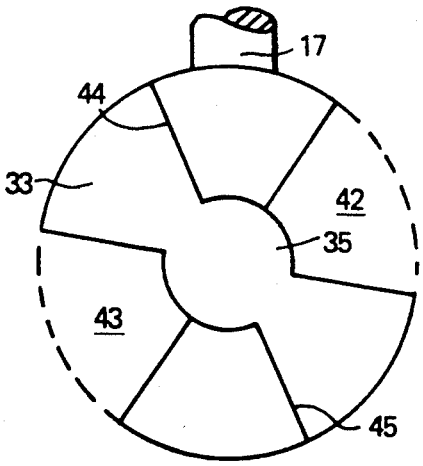
Figure 7:
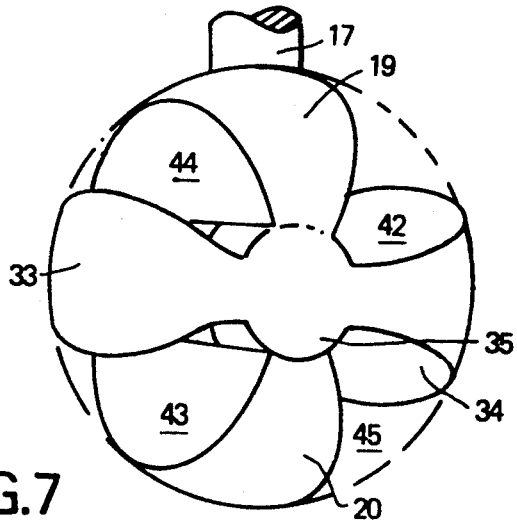
Figure 8:
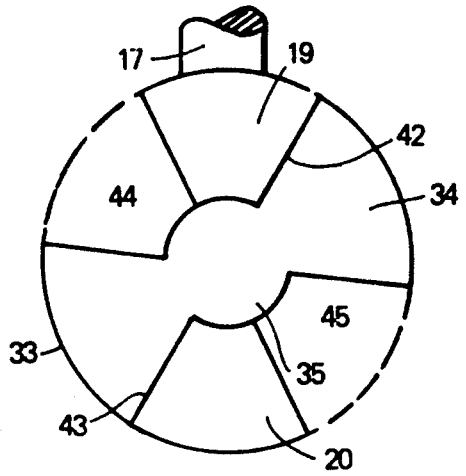
Figure 9:
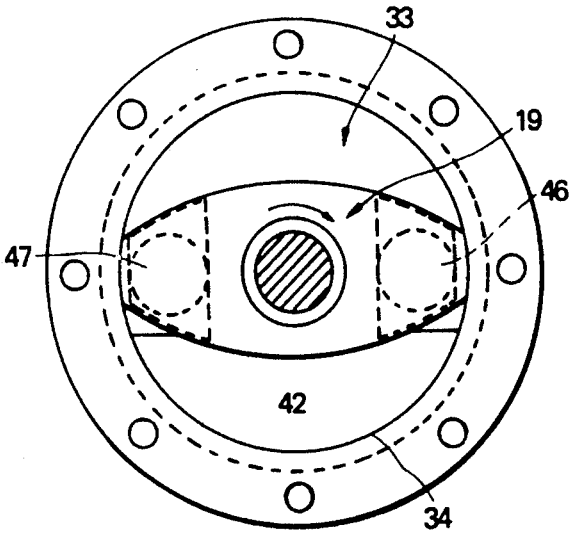
Figure 10:
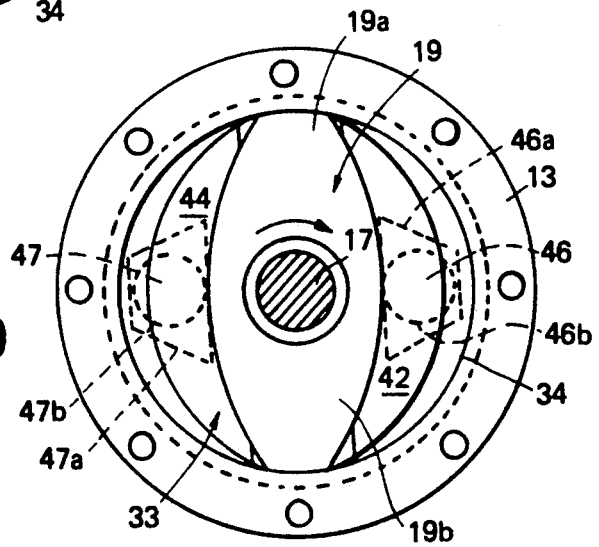
Figure 11:
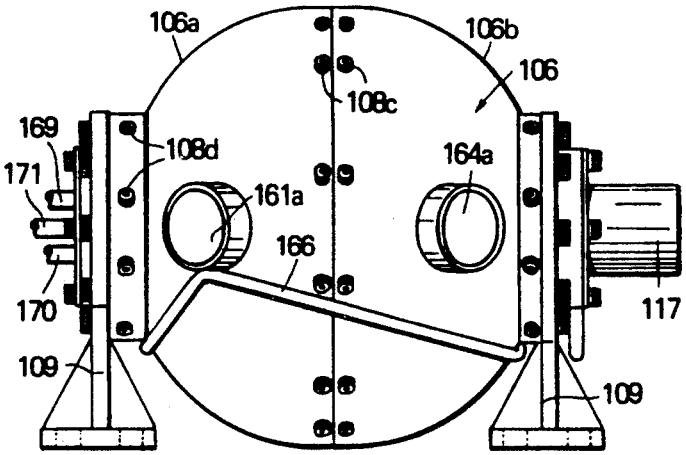
Figure 14:
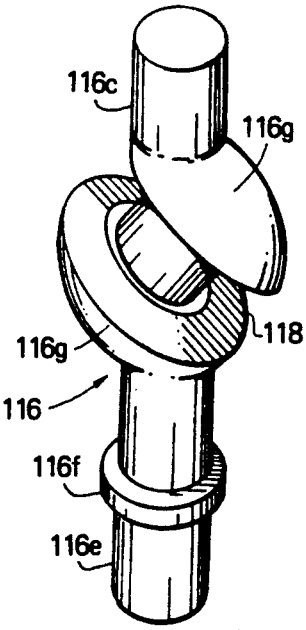
Figure 12:
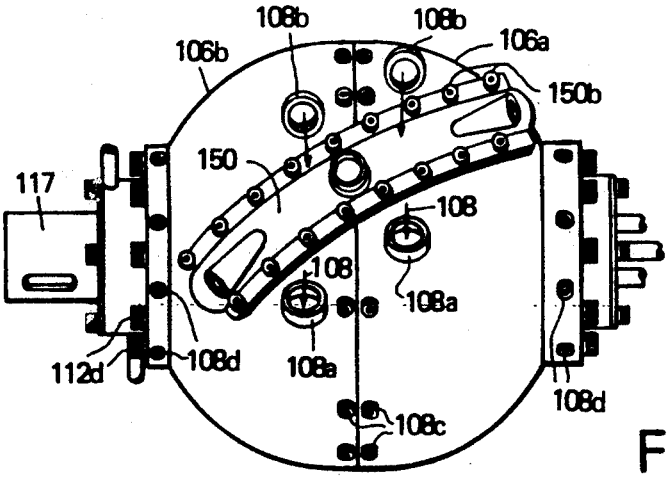
Figure 13:
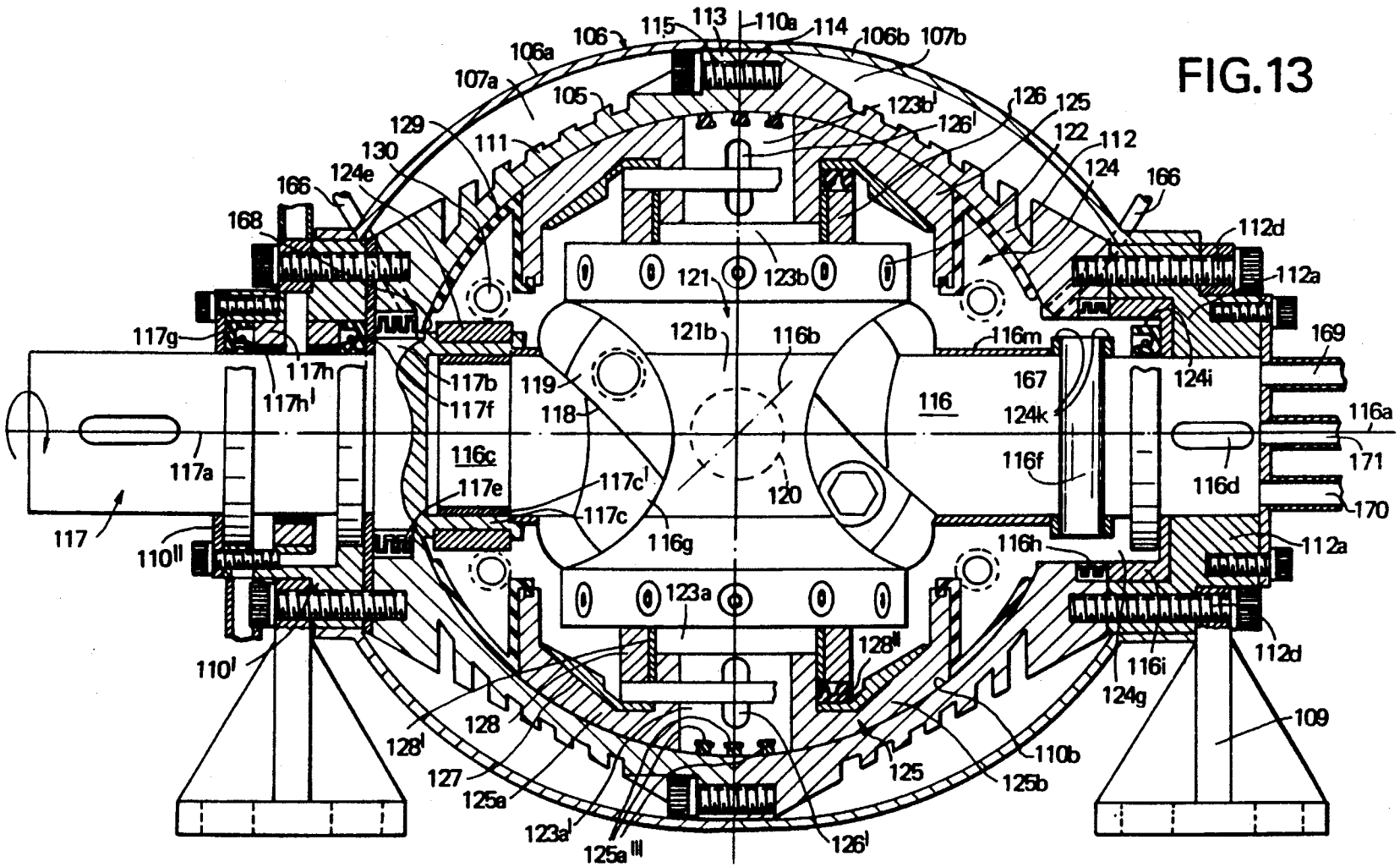
Figure 14A:
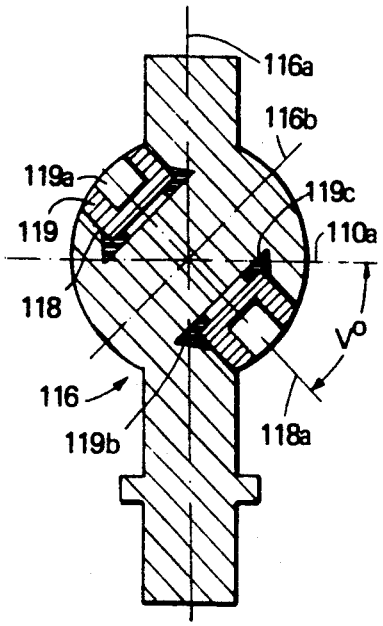
Figure 16:
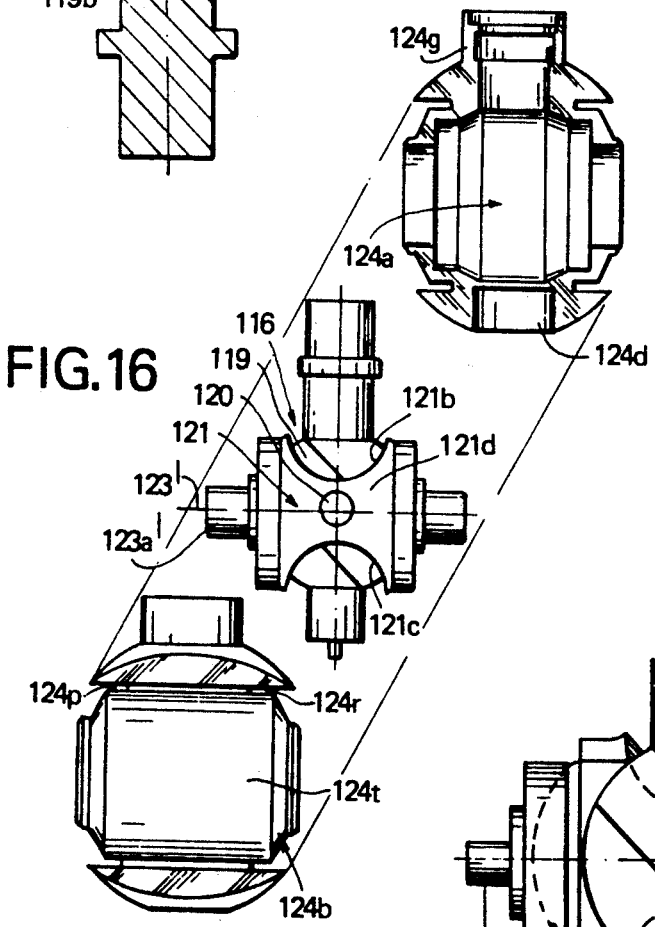
Figure 15:
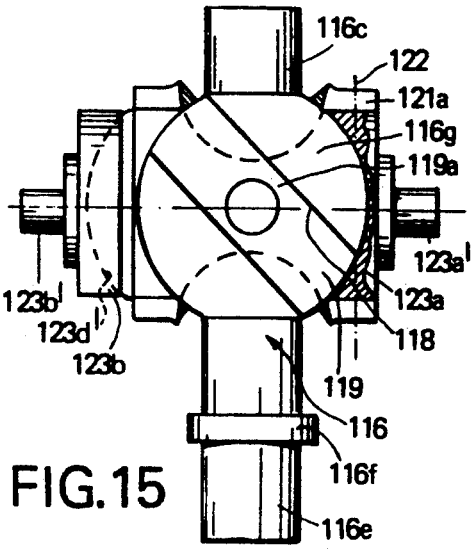
Figure 17:
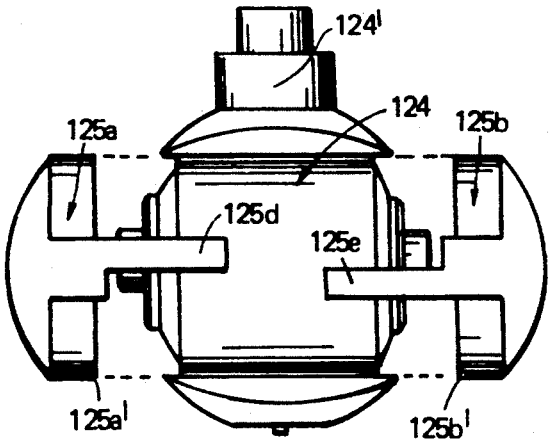
Figure 16A:
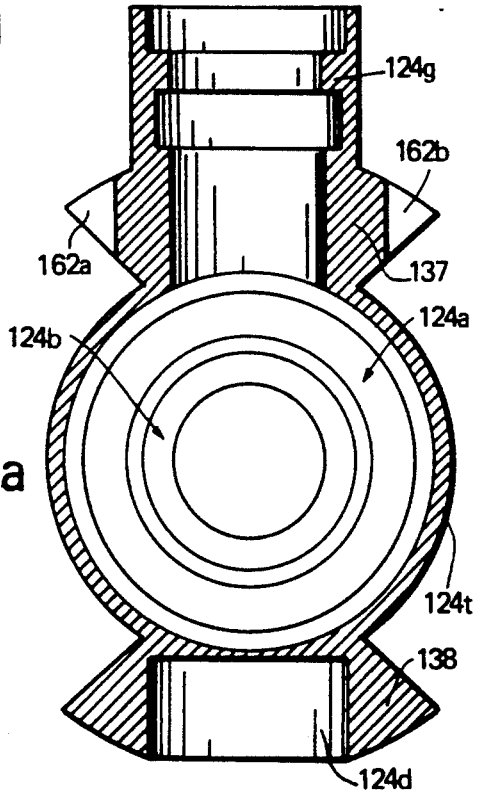
Figure 18:
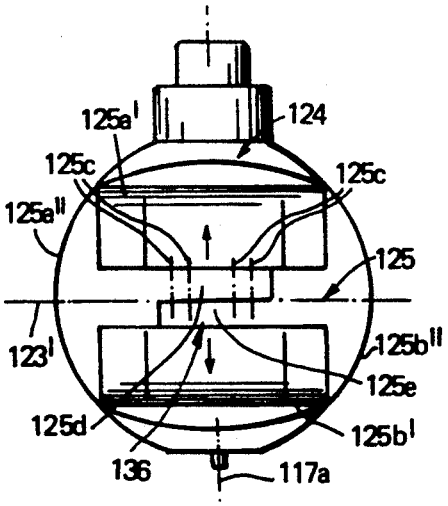
Figure 19:
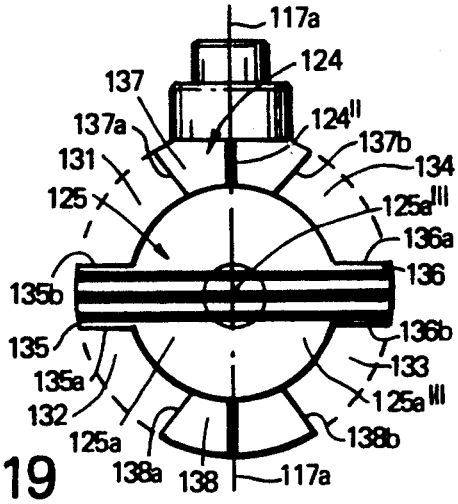
Figure 24:
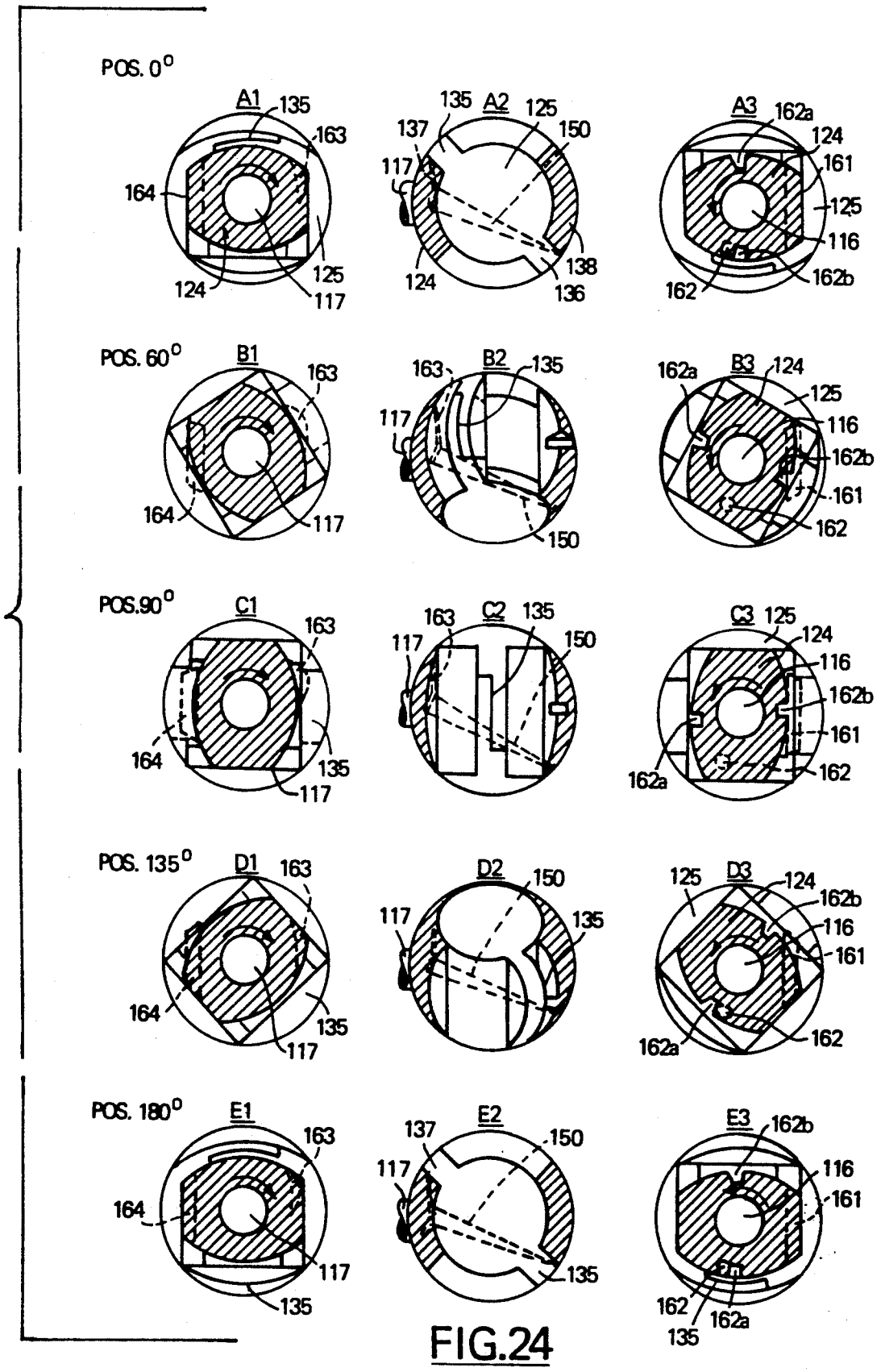

Further features of the present invention will appear from the description below with reference to the accompanying drawings in which:

FIG. 1 is a plan view of a power conversion machine according to the invention, illustrated in a first embodiment in the form of a compressor, FIG. 2 is a vertical cross-section of the machine in FIG. 1, FIG. 3 is a perspective view of a first rotor part, FIG. 4 is a perspective view of a second rotor part, FIG. 4*a* is a side view of the rotor part in FIG. 3 and the rotor part in FIG. 4 in engagement with each other, portions of the second rotor part in FIG. 4 being shown in cross-section, FIG. 5 is a vertical cross-section of the parts constituting the stator of the machine, FIGS. 6–8 illustrate the rotor assembly of the machine in three different operating positions, FIGS. 9–10 illustrate the first and the second rotor part received in one housing section and shown in two different operating positions at an angular displacement of 90°, FIG. 11 is a perspective view of the inventive machine in the form of a four-stroke internal combustion engine, an intake port and an exhaust port being especially shown, FIG. 12 is the same view as in FIG. 11, shown from the opposite side and with certain parts broken away for better clarity, the engine and the external combustion chamber being especially shown, FIG. 13 is a cross-sectional view of the engine in FIGS. 11 and 12, FIG. 14 is a perspective view of the guide means for a second rotor part, FIG. 14*a* is a cross-sectional view of the stationary guide means and the guide member of the second rotor part mounted in the associated guide groove, FIG. 15 is a side view, partly in section, of the guide means in FIG. 14 and the associated guide member during mounting in connecting means which connect the guide member to the second rotor part, FIG. 16 is an exploded view of the assembly comprising the guide member and the connecting means positioned between two halves which together constitute the first rotor part, FIG. 16*a* is a cross-sectional view of the first rotor part, with an angular displacement of 90° in relation to the view in FIG. 16, FIG. 17 illustrates the first rotor part which comprises the halves shown in FIG. 16, positioned between two portions which are included in the second rotor part, FIG. 18 illustrates the halves of the second rotor part, as shown in FIG. 17, in the assembled state, FIG. 19 is a side view of the parts shown in FIG. 18 as seen from the right side in FIG. 18, FIG. 20 is partly a side view and partly a longitudinal section of a portion of the second rotor part, FIGS. 21 and 22 are end views of two halves which together constitute the engine housing as shown in FIG. 13, FIG. 23 is a longitudinal section of a structural member containing a combustion chamber outside the engine, and FIG. 24 comprises schematic views of the first and the second rotor part in various angular positions relative to one another, thereby to illustrate the covering and uncovering of the ports in the various strokes in a four-stroke internal combustion engine as shown in FIGS. 11–23.

As mentioned by way of introduction, the power conversion machine according to the invention can be used in a number of different fields, e.g. as a one-stage or multistage compressor, or as a pump, a pneumatically or hydraulically operated engine, or as an internal combustion engine or the like. The machine or the engine according to the invention can be used in a number of different fields and in a number of different combinations, without all such embodiments being stated herein. Examples of a simple engine unit are given below, while in practice a number of different possibilities of combination which can bring considerable advantages, are also feasible, for example when arranging machines or engines in tandem connection or in interacting operation in some other manner.

POWER CONVERSION MACHINE IN THE FORM OF A COMPRESSOR

In a first embodiment as illustrated in FIGS. 1–10, the power conversion machine according to the invention will be described in an especially simple embodiment in the form of a compressor. The parts which are described with reference to FIGS. 1–10 are, however, not limited to be used in a compressor, but can in principle just as well be used in other types of machines, without concrete examples thereof being mentioned below.

The machine according to the first embodiment generally comprises a machine housing 10, a rotor assembly having a first rotor part 19–21 and a second rotor part 33–35, a radially inner guide means 16 which is stationarily mounted in the machine housing and intended for a guide member 38 which is rotatably mounted in a separate plane of rotation. The guide member 38 positively guides the second rotor part 33–35 in a rocking movement back and forth relative to the first rotor part 19–21 which exclusively performs a movement of rotation.

FIG. 1 shows a spherical machine housing 10 with a spherical inner cavity. The housing is composed of two halves 11 and 12 and is divided along a transverse center plane or radial plane 10*a* which is indicated by dash-dot lines in FIGS. 1, 2 and 5. The halves 11, 12 are each, provided with a mounting flange 13 and 14, respectively, which are joined together by a number of mounting bolts 15*a* and mounting nuts 15*b*. There are shown two machine foundations 100*a*, 100*b* with mounting holes 101 for mounting bolts (not shown).

The stator 10, 16 of the machine is shown in FIG. 5, while the rotor assembly 19–21, 33–35 of the machine is shown in FIGS. 6–8. The stator and the rotor assembly of the machine are shown in more detail in the mounted state in FIGS. 2 and 4*a*. The first rotor part 19–21 and the second rotor part 33–35 are each shown separately in FIGS. 3 and 4.

To one half 11 of the machine housing, there is permanently attached a substantially bar-shaped, stationary guide means 16 which extends through the spherical cavity 10*b* in the spherical housing 10 (see FIG. 2) transversely of the center plane 10*a* and extends a distance axially beyond the spherical cavity of the machine housing at the upper end of the machine housing as shown in the drawing. The guide means 16 has a longitudinal axis 16*a* which coincides with the axis of rotation 17*a* of a rotary shaft 17. A thicker end 16*b* of the guide means 16 is rigidly connected with one half 11 of the housing, such that the guide means 16 together with the halves 11 and 12 form a stator assembly.

In the upper part of the drawing (see FIG. 5), the guide means 16 is formed with a stem-shaped portion 16*c* followed by a ball-shaped intermediate portion 16*d* and a lower stem-shaped portion 16*e* merging into the lower thicker portion 16*b* by which the guide means is connected with the half 11 of the housing.

In the other half 12 of the housing, the axially inner end 17*b* of the rotary shaft 17 is rotatably mounted in a radially inner rotary bearing 18. The axially opposite end 17*c* of the rotary shaft 17 extends endwise beyond the housing 10 for engagement with a power-operated driving means (not shown) for rotating the rotary shaft 17 in, relation to the housing 10 and the guide means 16.

The first rotor part 19–21 is rigidly connected to the inner end 17*b* of the rotary shaft 17. The rotor part comprises a first pair of pistons 19, 20 which are rigidly interconnected by a common hub portion 21. The first rotorforming part 19–21 is non-rotatably connected to the rotary shaft 17. The rotor part 19–21 is rotatably mounted on external bearing surfaces 22, 23, 24 adjacent the axially inner end 16*b* of the guide means 16 and on radially external bearing surfaces 25, 26 adjacent the axially outer end 16*c* of the guide means 16. The outer end 16*c* of the guide means 16 projects endwise into the inner end 17*b* of the rotary shaft 17, such that the inner end 17*b*, radially internally, is rotatably mounted on the outer end 16*c* of the guide means 16 and, radially externally, is rotatably mounted in the rotary bearing 18 in the half 12 of the housing.

As appears from FIG. 3, the pistons 19, 20 and the hub portion 21 are divided into two halves 19*a*, 20*a*, 21*a* and 19*b*, 20*b*, 21*b* along a partition surface indicated by the parting line 27, such that the two halves can be mounted about the guide means 16 from opposite sides, while this is attached to the half 11 of the housing, but before the half 12 of the housing is mounted on the half 11 of the housing.

The pistons 19, 20 have the shape of elongate ball segments. The hub portion 21 which is located centrally in the housing 10 has the shape of two axially spaced-apart, cylinder-shaped sleeves 21*a* and 21*b* with an intermediate gap 21*c*. The sleeves 21*a*, 21*b* extend over a length of about $\frac{1}{3}$ of the inner diameter of the housing 10. The sleeves define between themselves an intermediate ball-shaped cavity 28 (see FIGS. 2 and 4*a*) which receives the ball-shaped intermediate portion 16*d* of the guide means 16 and an associated annular guide member 38. The guide member 38 is provided with pins 39 extending radially outwards from the guide means 16 and from the ball-shaped cavity 28 via said gap 21*c* in the rotor part 19–21.

At the opposite ends of the hub portion 21 there is formed a recess 31 and 32, respectively (FIG. 3) with cylindrically curved surfaces 31*a*, 31*b* and, respectively 32*a*, 32*b*.

To the first rotor part 19–21 there is attached separate second rotor part 33–35 which is shown in more detail in FIG. 4. As appears from FIGS. 2 and 4*a*, the rotor parts 19–21 and 31–35 constitute a rotor assembly. The rotor part 33–35 comprises two pistons 33, 34 and an intermediate hub portion 35. In conformity with the pistons 19, 20 and the hub portion 21, the pistons 33, 34 and the hub portion 35 are divided into two halves 33*a*, 34*a*, 35*a* and, respectively 33*b*, 34*b*, 35*b* by means of a partition plane which as shown in FIG. 4 is in the form of a parting line 37. The two hub portion halves 35*a*, 35*b* are, however, divided such that they form between themselves a cavity for receiving the hub portion halves 21*a*, 21*b* of the first rotor part.

In mounting, the guide member (guide ring) 38 is first mounted on the guide means 16. Subsequently, the two halves of the first rotor part 19–21 is mounted in the lower half 11 of the housing about the guide means 16 from opposite sides thereof and simultaneously in firm rotary engagement with the rotary shaft 17. Then the second rotor part 33–35 can be mounted on the first rotor part 19–21. In practice, one half 33*a*, 34*a*, 35*a* of the second rotor part can be mounted on the corresponding half 19*a*, 20*a*, 21*a* of the first rotor part. Correspondingly, the other half 33*b*, 34*b*, 35*b* of the second rotor part can be moved lengthwise into engagement with the corresponding other half 19*b*, 20*b*, 21*b* of the first rotor part.

The annular guide member 38 is divided into two sections 38*a*, 38*b* as shown in FIG. 4. The guide member 38 comprises two pins 39 which extend radially outwards and are made coherent with a respective one of the two ring halves 38*a*, 38*b*. The opposite end of the pins is rotatably mounted in a corresponding bore forming a rotary bearing in the respective two piston parts 33, 34 of the second rotor part 33–35. The ring 38 is rotatably mounted in a groove 41 in the ball-shaped portion 16*d* of the guide means 16 and is, together therewith, mounted in the ball-shaped cavity 28 between the hub portion sleeves 21*a* and 21*b* of the first rotor part, as shown in FIG. 4*a*. The central main plane of the ring groove 41, which is indicated by a dash-dot line 41*a*, in FIG. 5 makes an angle v with the plane 10*a* extending at right angles to the center axis 16*a* of the guide means 16.

In the embodiment illustrated, the angle v is shown to be 30°, but in practice it can be larger or smaller, as desired and required. When the angle v is chosen to be for example 30°, the second pair of pistons can be moved through 60° in relation to the first pair of pistons in each stroke. If the pistons are made thinner, one can, for example, use an angle of 45°, which results in an angular movement of 90° for each of the pistons in the second pair of pistons in relation to the first pair of pistons in each stroke. The pistons can have the shape of ball segments or are in any case formed with spherical outer surfaces corresponding to the spherical inner side surface of the machine housing.

As appears from FIG. 2, the rotor parts 19–21 and 33–35 constitute a rotor assembly which is adapted to rotate about the axis 17*a* of the rotary shaft 17 in relation to a stator assembly mounted in the housing 10 and comprising the guide means 16.

The second rotor part 33–35 is positively rocked in a reciprocating motion in relation to the first rotor part 19–21 about a pivot axis 35*c* (see FIG. 4) which extends centrally through the hub portions 35*a*, 35*b* of the second rotor part 33–35 and intersects the axis 17*a* of the rotary shaft 17 at right angles to the axis in the center of the cavity 10*b*. Pins extend through intermediate gap 21*c* between hub portion sleeves 21*a* and 21*b* of the first rotor part so as to be rotated by the first rotor part. In consequence of the positive guiding of the ring 38 in the plane 41*a* in the annular groove 41 in the stationary guide means 16, the guide ring 38 is rotated in a separate path of revolution in relation to the guide means 16, i.e. it is rotated in the plane 41*a* which extends obliquely to the plane of rotation of the first rotor part 19–21, which extends at right angles to the axis of rotation 17*a*. The pins 39 of the guide ring 38 will perform a pivoting movement back and forth in relation to the pistons 33, 34, and consequently the second rotor part 33–35 will be put into a positive rocking movement back and forth about the pivot axis 35*c*, at the same time as the first rotor part 19–21 (and the second rotor part 33–35) makes a revolution about the axis of rotation 17*a* of the rotary shaft 17.

THE WORKING CHAMBERS OF THE COMPRESSOR

As shown in FIGS. 2 and 6–10, two pairs working chambers 42, 43 and 44, 45 are formed, i.e. one pair of working chambers on each side of the pistons 19 and 20 and, respectively, on each side of the pistons 33, 34. For better understanding of the mode of operation of the pistons, the pistons 19, 20 can be regarded as relatively static in relation to the piston 33, 34. It appears that the rocking movement is only carried out by the pistons 33, 34, and these working chambers are expanded or compressed as a consequence of the movement of the pistons 33, 34 in relation to the pistons 19, 20. However, the pistons 19, 20 and the pistons 33, 34 will perform a synchronous rotation about the axis 17*a* of the rotary shaft 17, but with a movement of rotation in the radial plane at right angles to the axis 17*a* of the rotary shaft 17 in respect of the pistons 19, 20, and with a movement of rotation in the radial plane which extends obliquely to the axis 17*a*, in respect of the pistons 33, 34. The pistons 33, 34 rocking back and forth do not perform an ordinary reverse movement in their extreme positions, but a movement of rotation which is continuous in space and has no dead centers.

As appears from FIG. 5, the housing 10 and the guide means 16 constitute a stator assembly. The first rotor part 19–21 is rotatably mounted on the guide means 16 about the axis 17*a*, while the second rotor part 33–35 is rockably mounted on the first rotor part 19–21 about the axis 35*c* and is rockably connected to the guide ring 38 which is rotatably mounted on the guide means 16. The positive rocking movement which the second rotor part 33-35 performs in relation to the first rotor part, is of course guided by means of the inclined guiding groove 41 in the ball-shaped portion 16*d* of the guide means 16.

FIGS. 6–8 illustrate the pistons 19, 20 and 33, 34 in three different phases of the rocking movement of the pistons 33, 34 in relation to the pistons 19, 20. In a first phase as shown in FIGS. 6 and 9, the working chambers 42, 43 are shown in the lateral direction in FIG. 6 and from above in FIG. 9 and with their maximum volume, whereas the working chambers 44, 45 are shown with their minimum volume. In a second, intermediate phase as shown in FIGS. 7 and 10, the pistons are for better clarity shown in a perspective view in FIG. 7 and from above in FIG. 10 and with correspondingly large working chambers 42–45. FIG. 8 shows the pistons in a third phase in which the working chambers 44, 45 have their maximum volume, whereas the working chambers 42, 43 have their minimum volume. When the rotor assembly is moved through half a revolution about the axis 17*a*, the pistons are subjected to the above-mentioned three phases as shown in FIGS. 6–8 in a first stroke, and while the rotor assembly is further moved through half a revolution about the axis 17*a*, the pistons run through the corresponding three phases in the opposite order. It is thus obvious that each of the four working chambers 42–45, in a full revolution of the rotor assembly, is subjected to two successive strokes, and for each revolution of the rotor assembly, four units of volume corresponding to the volumes of the four working chambers are emptied and filled.

The filling and emptying of the working chambers 42–45 are effected via two pairs of intake ports 46 (only one indicated by dashed lines in FIGS. 9 and 10) and two exhaust ports 47 via associated pairs of exhaust pipes 48 and intake pipes 49 (FIG. 1). Use can of course be made of an intake port and an exhaust port in each of the halves 11 and 12 of the housing and, of course, a common intake port and a common exhaust port for each pair of working chambers which are positioned each on one side of the pistons 19, 20. In FIGS. 9 and 10, there are indicated quadrangular inner apertures 46*a*, 47*a* opening into the cavity 10*b* and circular outer apertures 46*b*, 47*b* opening into the pipes 48, 49. In the embodiment shown, all ports 46 and 47 are adapted to open and close in the extreme positions of the pistons as illustrated in FIGS. 6 and 8 and to be, as it were, fully uncovered in the intermediate positions shown in FIG. 7. In practice, it is however possible to dimension, form and position the ports such that they are kept open in the entire stroke or just in certain parts of each stroke, as required.

FIG. 2 shows sealing means 52 on the surfaces of the pistons 33, 34, which are directed radially inwards and face the hub portion 21 of the rotor part 19–21, and sealing means 53 on the surfaces of the pistons 33, 34, which are directed radially outwards and face the inner surface of the housing 10. Corresponding sealing means 50 are in FIG. 2 shown on the surfaces of the pistons 19, 20, which face radially outwards. In FIG. 3, sealing rings 51 are indicated on the radial surfaces of the hub portion 21. An efficient seal between the rotor parts and between each rotor part and the housing 10 can be established in a relatively simple manner.

It is not here described but it will be possible to provide effective lubricating and cooling of the rotor assembly by supplying a circulating lubricating and cooling medium via the guide means 16 and the rotary shaft 17, respectively, to each rotor part.

POWER CONVERSION MACHINE IN THE FORM OF AN INTERNAL COMBUSTION ENGINE

Below follows a description of an embodiment which is especially adapted to use in an internal combustion engine, but the same design as is described for the rotor in the internal combustion engine can also be used for the rotor in other types of machine, e.g. for a machine in the form of a pump, compressor or the like, without especially exemplifying this. The most essential difference is that the machine housing is adapted to the respective use, while the same motor assembly can be used in all the different applications. In a rotor assembly for an internal combustion engine, the rotor parts can of course be subjected to surface treatment or be specially made, such that they can be especially heat-resistant and heat-insulated, for example by means of ceramic materials, whereas such surface treatment or such special manufacture of the rotor parts is not absolutely necessary for other types of machine.

FIGS. 11–24 illustrate a second embodiment of the machine according to the invention in the form of an internal combustion engine. More precisely, there is shown a four-stroke double-acting internal combustion engine having an external combustion chamber.

Alternatively, use can be made of a corresponding engine having an internal combustion chamber, without a concrete embodiment thereof being shown.

This also applies to other types of internal combustion engine. Even if no concrete embodiments are shown, the internal combustion engine can be used as e.g. a two-stroke single-acting engine having external or internal combustion chambers, without any examples thereof being given.

FIG. 13 shows an engine housing 110 which consists of two halves 111 and 112 and which is divided along a transverse center plane 110*a*. The halves of the housing are each provided with a mounting flange 113 and 114, respectively, which are joined by a number of mounting bolts 115.

The exterior of the engine housing 110 is provided with cooling fins 105. The engine housing 110 is enclosed by a casing 106, thereby to define two separate water chambers 107 between the engine housing 110 and the casing 106, for circulating the cooling water in each water chamber separately. The circulation of cooling water is in FIG. 12 indicated by arrows 108, and the inlet of cooling water is indicated by arrow 108*a* and the outlet of cooling water is indicated by arrow 108*b*. The two parts 106*a* and 106*b* of the cooling water casing are attached by screws 108*c* to the flanges 113 and 114 of the engine housing 110, and by screws 108*d* to the opposite ends of the engine housing 110. At 109, there are shown mounting brackets for mounting the engine in horizontal position to a base.

In FIG. 11, there is connected to an air inlet nozzle 161*a* a branch suction line 166 which opens into a defined area 167 and 168, respectively (see FIG. 13) between the outer surface of the rotor part 124, which has the smallest diameter and the inner surface of the halves 111 and 112 of the engine housing, which has the smallest diameter. This makes its possible to remove, in per se known manner, via the air inlet, undesired gas residues from the cavity of the engine housing, without such residues having to come into contact with the lubrication system inside the rotor assembly.

In FIG. 13, there are, at the end of the engine, which supports the guide means 116 constituting the stator, connected one supply pipe 169 and two return pipes 170, 171 for lubricating oil which is distributed via the stationary guide means 116 to the guiding groove 118 and to the rotary parts which enclose the guide means 116 inside the rotor assembly 124, 125.

FIG. 13 illustrates the most vital parts of the engine in the assembled state. Some parts are removed for better clarity. These most vital parts are shown in more detail in FIGS. 14–23. Below reference will be made alternately to the general plan in FIG. 13 and the detailed plans in FIGS. 14–23.

THE GUIDE MEANS OF THE ROTOR ASSEMBLY

To the right end of the engine housing 110 in FIG. 13 there is attached an elongate guide means 116 which extends through a spherical cavity 110*b* in the engine housing 110, transversely of the center plane 110*a*. The guide means 116 has a longitudinal axis 116*a* (see also FIG. 14) which coincides with the axis of rotation 117*a* of a rotary shaft 117, i.e. the driven shaft of the engine. The guide means 116 is guided endwise in a bore 117*c* in the right end 117*b* of the rotary shaft 117. There is shown a bearing guide 117*c*′ in the bore 117*c* of the rotary shaft 117 for support of the end portion 116*c* of the guide means 116 to the left in FIG. 13. Said left end 116*c* of the guide means 116 is inserted in and enclosed by the lower end of the rotary shaft 117.

By means of a key groove 116*d* in the guide means 116 and a corresponding key groove (not shown) in a terminal cover 112*a* mounted on the housing portion 112 by bolts 112*d* and corresponding keys (not shown), the guide means 116 is permanently attached to the housing portion 112. Consequently, the guide means 116 constitutes together with the engine housing a stator assembly (see FIG. 14). A rotor 124, 125 is guided out of this stator assembly, said rotor being built up around the guide means 116 inside the spherical cavity 110*b* of the engine housing, as will be described in detail below.

The guide means 116 as shown in FIG. 14 is formed with a lower stem-shaped portion 116*e* which approximately in the middle of the lower stem portion has a stop-forming, annular collar portion 116*f*. Moreover, the guide means is formed with a ball-shaped hub portion 116*g* having an annular groove 118, and an upper stem-shaped portion 116*c*. The groove 118 is of dovetail-shaped cross-section and extends in a plane which is indicated by dash-dot lines 118*a* and which makes an angle v with the parting line 110*a*. In the groove 118 there is arranged a guide member in the form of a guide ring 119. The guide ring 119 is divided into two sections along a plane through the axis 116*b* (FIG. 14*a*), thereby to allow mounting in the groove 118. In the illustrated embodiment the guide ring 119 is located between two separate bearing guides 119*b* and 119*c*. The guide ring 119 is on two diametrically opposite sides provided with bores 119*a* which form radially outwardly open pivot bearings and which are adapted to receive corresponding, radially inwardly extending pins 120 which extend radially inwards from a connecting means 121 constituting guide means (see FIGS. 16 and 20). The connecting means 121 is included in the second rotor part 125, as will be described below. Said first rotor part 124, said second rotor part 125 and said guide ring 119 are all incorporated in a common rotor assembly.

THE ROTOR ASSEMBLY CONNECTION WITH THE GUIDE MEANS

FIG. 15 illustrates the mounting of the guide means 116 and the associated guide member or guide ring 119 in the connecting means 121. The connecting means 121 consists of two halves 121*a*, 121*b* of which only one half 121*a* is shown in FIG. 15, while the other half 121*b* is shown in FIGS. 13 and 16. The spherical hub portion 116*g* of the guide means 116 is received in a correspondingly spherical recess (not shown) on the inside of the halves 121*a*, 121*b*, while two separate end pieces 123*a* and 123*b* are inserted endwise from opposite sides of the connecting means 121 and are connected to the respective two halves 121*a*, 121*b* thereof by means of mounting screws 122 (see FIG. 13) which are indicated by dash-dot lines to the right in FIG. 15. In FIG. 15 one end piece 123*a* is mounted in the connecting means 121, whereas the other end piece 123*b* is ready to be moved in between the halves 121*a*, 121*b* (the half 121*b* is not shown in FIG. 15 for better clarity, but is assembled with the half 121*a* in connection with the respective end piece 123*a*, 123*b*). The end pieces 123*a*, 123*b* are formed with a spherically curved inner surface as indicated by a dashed line 123*d*'. The end pieces 123*a* and 123*b* are each provided with a terminal pin 123*a*', 123*b*'.

As shown in FIG. 13, the terminal pins 123*a*', 123*b*' are rigidly connected to the rotor part 125 via spacer sleeves 126 and intermediate keys as shown by means of a key groove 126'.

FIG. 16 shows the connecting means 121 mounted around the guide means 116 and the guide ring 119 and locked relative to the hub portion of the guide means 116 by means of the end pieces 123*a*, 123*b* which are screwed to the two opposite portions 121*a*, 121*b* of the connecting means 121. By means of recesses 121*c*, 121*d* in the connecting means 121, as shown in FIG. 16, the connecting means 121 is allowed to rock in a rocking movement back and forth along a certain, limited arc about an axis 123' extending through the pins 123*a*' and 123*b*'. Since the connecting means 121 forms connecting means between the guide ring 119 and the second rotor part 125, the connecting means 121 is subjected to rotation about the axis of rotation 117*a* in conformity with the rotor part 125 as such. As a result of the positive rotation of the guide ring 119 about an axis 116*b* (FIGS. 13 and 14*a*) which extends at right angles to the plane 118*a*, the connecting means 121 performs, owing to the pin connections between the connecting means 121 and the guide ring 119, an additional rocking movement about the axis 123' in addition to the movement of rotation about the axis 117*a*. This rocking movement is transferred via the terminal pins 123*a*, 123*b* of the connecting means 121 to the rotor part 125. The rotor part 125 performs a corresponding positive rocking movement in relation to the rotor part 124, as will be described in detail below, at the same time as the parts 121, 124, 125 perform a conjoint movement of rotation about the axis of rotation 117*a*.

THE FIRST ROTOR PART OF THE ROTOR ASSEMBLY

FIG. 16 is an exploded view and illustrates how the parts 116, 119 and 121 are received in enclosed manner between two housing portions 124*a*, 124*b* of the first rotor part 124.

FIG. 17 shows the housing portions 124*a*, 124*b*, assembled to a coherent rotor part 124 forming a housing. The rotor part 124 has a main axis 124' which coincides with the axis of rotation 117*a* of the rotary shaft 117, and the housing or rotor part 124 performs a movement identical with and along with that of the rotary shaft 117 of the engine.

The first rotor part, i.e. the housing 124, encloses, by means of an upper end sleeve portion 124*d* shown in FIG. 16, the lower end of the rotary shaft 117 and is rigidly connected thereto via a mounting key 124*e* (see FIG. 13), such that the housing 124 is non-rotatably connected to the rotary shaft 117. There are shown a labyrinth seal 117*e* between the half 111 of the engine housing and the rotary shaft 117, two sealing rings (radial packing rings) 117*f*, 117*g* and an intermediate bearing ring 117*h* with a bearing guide 117*h*' between the rotary shaft 117 and a bearing housing 110' and an associated end cover 110''. Correspondingly, there are arranged an end cover 116*i* for retaining a sealing ring (radial packing ring) 124*i* at the sleeve-shaped end portion 124*g* of the housing 124. In a first groove in the housing 124 there is arranged a sealing ring (radial packing ring) 124*i*, and in a second groove there are arranged two thrust bearings 124*k* each on one side of the annular collar portion 116*f* (see FIGS. 12 and 13). At 124*m* there is shown a bearing guide for supporting the guide means 116. Between the half 112 of the housing and the end cover 116*i* in the terminal cover 112*a* of the housing 110, there is shown a labyrinth seal 116*h*.

THE SECOND ROTOR PART OF THE ROTOR ASSEMBLY

FIG. 17 illustrates two end pieces 125*a*, 125*b* which jointly (and together with the connecting means 121)

are to form a coherent rotor part 125 and which from opposite sides are passed onto the housing 124.

As shown in the housing portion 124*a* in the upper part of FIG. 16 and in the housing portion 124*b* in the lower part of FIG. 16, the second rotor part 124 is provided with a sleeve-shaped hub portion 124*t* whose outside guides the pistons 135, 136 of the second rotor part 125 and whose inside guides the connecting means 121.

FIG. 18 illustrates the two end pieces 125*a*, 125*b* after being assembled so as to form the coherent rotor part 125 by means of common mounting screws as shown by dash-dot lines 125*c* via overlapping finger-shaped portions 125*d*, 125*e*. The finger-shaped portions 125*d*, 125*e* extend endwise outwards in the axial direction on mutually opposite sides of part-spherical portions 125*a*', 125*b*'. The axially directed flange portions 125*a*', 125*b*' extend between the finger-shaped portions 125*d*, 125*e*. FIG. 19 illustrates the end piece 125*a* (corresponding to the end piece 125*b*) as seen from one end. There are shown sealing rings 125*a*''' for sealing the end pieces 125*a*, 125*b* of the rotor assembly against the spherical inner wall of the engine housing (in the cavity 110*b*) and corresponding sealing rings 129 (see also FIG. 13) for sealing the housing 124 in relation to the spherical inner wall of the engine housing.

To assemble the end pieces 125*a*, 125*b* such as shown in FIGS. 17–18, the opposing edge flanges 125*a*', 125*b*' of the end pieces 125*a*, 125*b* are moved into corresponding recesses 124*p* and 124*r* in the connecting means 121. In the edge flanges 125*a*', 125*b*' there are arranged in corresponding sealing grooves two separate sealing rings 129 as shown by thick black lines in FIG. 13. The sealing rings 129 extend coherently in the longitudinal direction of the two opposing piston-forming portions of the first rotor part 124 and annularly in the intermediate area towards the edge flanges 125*a*', 125*b*'. FIG. 13 shows at 125*a*''', three sealing rings (see also FIG. 19) extending in parallel with each other and along the entire circumference of the second rotor part 125. The sealing rings 125*a*''' and 129 are designed with a largely T-shaped cross-section which is received in a correspondingly T-shaped groove, the cross-bar of the T shape being disposed at the bottom of the groove. In operation, the sealing ring is intended to be thrown by centripetal force against the inner wall of the engine housing and there get worn, thereby to ensure effective sealing engagement without any considerable friction between the parts. Inside the end pieces 125*a*, 125*b* (see FIG. 13), the sleeve-shaped bearings 126 accommodate the key 126' such that the pins 123*a*, 123*b* of the connecting means 121 can, as mentioned above, be rigidly connected to the end pieces 125*a*, 125*b*. As mentioned above, there is provided by means of the keys 126' a coherent rigid connection between the rotor parts 121, 125, such that they can perform a conjoint movement of rotation in relation to the rotor part 124. On the outside of the sleeve-shaped pivot bearing 126 there are shown an annular protective cover 127 between the housing portions 124*a* 124*b* and the end pieces 125*a*, 125*b* and axially inwards thereof, a rotary bearing 128 with an associated bearing guide 128' and a sealing ring (radial packing ring) 128'' arranged between the cover 127 and the rotary bearing 128 and, respectively, between the respective and piece 125*a*, 125*b* and the housing 124. FIG. 13 illustrates mounting bores 130 for assembling the housing portions 124*a* and 124*b*.

By means of a comparatively simple sealing system, it is thus possible to establish an efficient seal between the mutually movable rotor parts 124, 125 (and, respectively, between the rotor parts 124, 125 and the spherical inner surface of the engine housing), such that the guide means 116 and the associated guide member (guide ring) 119 and the connecting means 121 connected thereto are sealed radially inside the rotor parts 124, 125 of the engine and the associated working chambers 131–134, as will be described in detail below.

FIG. 18 shows the rotor parts 124, 125 from one side, and FIG. 19 shows the rotor parts 124, 125 after they have been rotated through 90° about the axis of rotation 117*a*. The rotor part 125 has two diametrically opposite pistons 135, 136 with opposing piston surfaces 135*a*, 135*b* and, respectively, 136*a*, 136*b*. The pistons 135, 136 which are jointly moved about the axis 135' (see FIG. 18) in relation to the housing 124, are formed of the projections 125*d* and 125*e* of the end pieces, said projections overlapping each other and forming fingers (FIG. 19 is an end view of the pistons 135, 136).

THE PISTONS OF THE ROTOR ASSEMBLY

The pistons 135, 136 are, as illustrated in FIG. 19, movable in a rocking manner back and forth in relation to the rotor part 124 away from and towards the opposite piston surfaces 137*a*, 137*b* of an upper piston 137 and, respectively, the opposite piston surfaces 138*a*, 138*b* of a lower piston 138. As shown in FIG. 19, working chambers 131–134 are defined inwardly of the dashed lines indicating the inner wall of the engine housing. A first upper working chamber 131 and a first lower working chamber 132 are defined between the pistons 137, 138 and the piston 135, while a second lower working chamber 133 and a second upper working chamber 134 are defined between the pistons 137, 138 and the piston 136.

During rotation of the rotary shaft 117, the rotor part 124 and the rotor part 125 perform a conjoint movement of rotation about the axis 117*a*.

Owing to the pin connection between the guide ring 119 of the guide means 116 and the connecting means 121, and the pin connection 123*a*, 123*b* between the connecting means 121 and the rotor part 125, the rotor part 125 performs, as a result of said rotation, a positive rocking movement in relation to the stationary guide means 116 and in relation to the rotor part 124. More precisely, the guide ring 119 performs a positive movement of rotation in the associated guiding groove 118 in the guide means 116 along the plane 118*a* (FIG. 14) and, at the same time as the connecting means 121 is rotated about the axis 117*a* together with the rotor part 125, the guide ring 119 positively causes a rocking movement of the motor part 125 via the connecting means 121 about the axis 123'. The pistons 135, 136 make a corresponding rocking movement back and forth between the pistons 137, 138 and alternately increase the volumes of the working chambers 131, 133, while the volumes of the working chambers 132, 134 are reduced, and vice versa.

For each revolution of the rotor part 124, 125 about the axis 117*a*, each of the working chambers 131, 133 is filled and emptied once, while each of the working chambers 132, 134 is correspondingly emptied and filled once, i.e. each working chamber is subjected to a complete emptying and filling cycle for each revolution. In working chambers:

1) suction stroke and 2) compression stroke, and for a second pair of working chambers:

3) combustion stroke and 4) exhaust stroke.

Each pair of working chambers 131, 132; 133, 134 are in turn each subjected to two subsequent strokes separately in a continuous cycle.

EXTERNAL CONNECTING CHAMBER/COMBUSTION CHAMBER

FIG. 12 illustrates an external connecting chamber, more precisely a combined connecting chamber and combustion chamber 150 which will be described in more detail below with reference to FIG. 23. Even if, according to a preferred embodiment, the engine is here described in connection with the external combustion chamber 150, the invention is not limited to the use of such an external combustion chamber. It will also be possible (even if it is not shown in detail) to effect the combustion in the cavity 110*b* of the actual engine, i.e. in the respective working chamber in the cavity 110*b* of the engine, as the working chambers take a corresponding position inside a determined range of angle of rotation in the cavity 110*b*. In the latter case, the chamber 150 will only serve as an external connecting chamber and in that case the chamber can be arranged as a duct in the actual engine housing. By connecting chamber is generally meant a connecting duct connecting one pair of working chambers with the other pair of working chambers, such that the two strokes in one pair of working chambers can continue in the next two strokes in the other pair of working chambers.

It is also possible to provide a four-stroke internal combustion engine without said connecting chamber even though there is no illustration herein of such an embodiment.

As appears from FIG. 23, the combustion chamber 150 is formed in a separate structural element 150*a* which can be made as a separate unit consisting of two halves 150*a'* and 150*a''* and which can be mounted separately outside the engine housing and on the outside of the casing 106 (not shown in FIG. 23). By means of connecting means 150*d* and 150*e* extending through the casing, and mounting screws 150*d'* and 150*e'*, the structural element 150*a* is mounted directly on the engine housing 110, the connection from the combustion chamber 150 to the ports 162 and 163 being open.

In an alternative case where the combustion occurs within the actual cavity 110*b*, the structural element 150*a* constitutes connecting means between two of the working chambers (compression chamber and combustion chamber, respectively). The two halves 150*a'*, 150*a''* of the structural element 150*a* (see FIG. 12) are joined by mounting bolts 150*b* and attached to the engine housing 110 by the mounting bolts 150*d'* and 150*e'*.

FIG. 23 is a cross-sectional view of the halves 150*a'*, 150*a''*, each of which is coated (in a manner not shown) on the inside, (optionally also on the outside) with a heat-resistant and heat-insulating layer of ceramic material, such that the combustion chamber can be held at an optimally high level of temperature, thereby to ensure optimal combustion at a high level of temperature. At the same time, it is possible to prevent removal of heat from the combustion chamber to the surroundings and, respectively, to the cooling water in the casing.

In the outer part 150*a''* of the structural element 150*a* and approximately in the center of the part 150*a''*, there is shown an insertion sleeve 150*f* for an igniting means (iginition plug) 150*f'*. The use of an incandescent tube or similar ignition means (e.g. diesel or semi-diesel engine) is also possible even though there is no specific illustration thereof herein. In opposite ends of the combustion chamber 150, there are formed inlet nozzles 150*g* and 150*h* which are adapted to supply fuel to the fuel chamber 150 in opposite directions as shown by arrows 150*g'* and 150*h'* towards the igniting means 150*f'*, i.e. in a co-current flow and, respectively, counter-flow relative to the direction of flow of compressed air/pressure gas as shown by arrows 150'.

The combustion chamber 150 is shown schematically and by way of example in FIG. 23, and it may be convenient to make various changes in the positioning of the fuel nozzles 150*g*, 150*h* and, respectively, the positioning of the igniting means 150*f'*, without necessitating special examples thereof. It may for example be convenient to position both (or a different number of) fuel nozzles on one and the same side of the igniting means 150*f'*, for example from opposite sides of the combustion chamber and optionally only in co-current flow relative to the direction of flow of the compressed air supplied to the combustion chamber.

In the embodiment illustrated in FIG. 23, the fuel chamber is shown to be of more or less constant cross-section in the entire longitudinal direction, but it may also be convenient to let the cross-sectional area increase from one side to the other in the fuel chamber, as indicated in FIG. 24.

It will also be possible to make recesses in the engine housing, such that the fuel chamber can be let directly into the engine housing, thereby to make the path of flowing of the pressure medium in the fuel chamber as short as possible.

In the embodiment shown, the volume in the fuel chamber is about 1/12 of the volume in each of the four working chambers of the engine, so that the compression of the compressed air in the combustion chamber can be 1/12 when injecting the compressed air from the working chamber to the combustion chamber. Other compression ratios can be used to change the volume in the fuel chamber, as required.

THE PORTS OF THE ENGINE HOUSING

FIGS. 21 and 22 are two opposite end views of the housing 110 of the engine, as seen in the axial direction of the engine, i.e. FIG. 21 is an end view from the side where the half 111 of the engine housing and the rotary shaft 117 are seen, while FIG. 22 is an end view from the side where the half 112 of the engine housing and the stator part 116 are seen.

FIG. 22 illustrates a first trapezoidal port 161 which constitutes the intake port from an air inlet 161*a* on the outside of the engine, as shown in FIG. 11, to the cavity 110*b* of the engine, and a second, largely rectangular port 162 which constitutes the exhaust port from the cavity 110*b* of the engine to the inlet side of the combustion chamber 150.

FIG. 21 shows a third, largely triangular port 163 which constitutes the intake port from the combustion chamber 150 to the cavity 110*b* of the engine, and a fourth, largely trapezoidal port 164 which constitutes the exhaust port from the cavity 110*b* of the engine to an exhaust outlet 164*a* on the outer side of the engine, as shown in FIG. 11.

MODE OF OPERATION OF THE ENGINE

FIG. 24 illustrates schematically at A1–A3, B1–B3, C1–C3, D1–D3, E1–E3 five different positions of rotation corresponding to the positions of the first and second rotor part of the rotor assembly (position A at 0°, position B at 60°, position C at 90°, position D at 135° and position E at 180°) in relation to the stator assembly (the guide means 116 and the engine housing 110). The direction of rotation is clockwise in the depictions A1–E1 and clockwise in the depictions A3–E3. For better clarity, the stator assembly is not shown, in that it is only indicated by the combustion chamber 150 and the ports 161–164 which are indicated by dashed lines. In all the depictions A1–E3, the stator assembly (the engine housing 110 and the guide means 116) is in one and the same position, as indicated by the ports 161–164 in the depictions A1, B1, C1, D1, E1 and A3, B3, C3, D3, E3 and, respectively, indicated by the combustion chamber 150 in the depictions A2, B2, C2, D2, E2. In order to distinguish the parts from each other, the spherical end faces of the first rotor part 124 are hatched.

The depictions A1, B1, C1, D1, E1 illustrate the rotor assembly 124, 125 as seen in the axial direction form the end where the drive shaft 117 is shown, whereas the depictions A3, B3, C3, D3, E3 are shown in the axial direction from the opposite end, i.e. from the end where the stator 116 is shown. The depictions A2, B2, C2, D2, E3 illustrate the rotor assembly 124, 125 as seen in the lateral direction.

The depictions A1–A3 illustrate the pistons 135, 136 of the rotor part 125 in the 0° position of the rotor assembly in one extreme position of the pistons, whereas the depictions C1–C3 illustrate the pistons 135, 136 in the 90° position of the rotor assembly in the intermediate position of the pistons, and the depictions E1–E3 illustrate the pistons 135, 136 in the 180° position of the rotor assembly (corresponding to the position in the depictions A1–A3, with the only difference that the pistons 135, 136 have changed positions) in the other extreme position of the pistons 135, 136.

In continued rotation of the rotor assembly through further 60° (to the 240° position) and rotation through further 30° (to the 270° position) and rotation through further 90° (to the 360° position), the pistons take the corresponding positions as shown in the depictions B1–B3, C1–C3 and A1–A3. In other words, for each (360°) rotation of the rotor assembly 124, 125, each of the pistons 135, 136, makes a rocking movement back and forth (90°+90° rocking movement) between their two extreme positions as illustrated in the depictions A1–A3 and E1–E3.

It will be understood from the depictions A2–E2 that the working chamber—positioned on the rear side of the piston 135 on the left-hand side of the piston 135 in depiction A2—after the first half revolution of the rotor assembly (180° rotation, i.e. 90° rocking movement) is expanded from its minimum to its maximum volume and then is positioned on the left-hand side of the piston 135 in depiction E2 and on the downwardly facing side of the rotor assembly. In the next half revolution of the rotor assembly (180° rotation, i.e. 90° rocking movement), said working chamber is however rotated, so that it will be correspondingly shown on the left-hand side of the piston, but then on the upwardly facing side of the rotor assembly.

Each working chamber will, in turn, perform a corresponding and, respectively, complementary movement. A first pair of working chambers, i.e. the two working chambers arranged each on one side of the piston 135, and a second pair of working chambers, i.e. the two working chambers arranged each on one side of the piston 136, pairwise perform a complementary movement. The working chamber on one side of the piston 135 and the working chamber on the corresponding one side of the piston 136 are included in the first two phases of the working cycle, whereas correspondingly the other two working chambers on the other side of the pistons 135, 136 are included in the two last phases of the working cycle. In this case, one pair of working chambers cooperate with the ports 161, 162, while the other pair of working chambers cooperate with the other pair of ports 163, 164.

In the 0° position (and the 180° and 360° position), all ports 161–164 are closed by the spherical circumferential surfaces of the first rotor part 124 (the end surfaces shown in A1 and A4).

As shown in the depictions A3–E3, the port 161 for air inlet is wholly or partly uncovered in relation to a first working chamber in the area between the extreme positions A3 and E3 (see positions B3, C3, D3), and is only closed in the extreme positions E3 and A3. As appears from the depictions A3–E3, the port 162 which constitutes the exhaust port to the combustion chamber 150 is only uncovered by the recesses **162*a* (162*b*) of the first rotary part 124** in the area between the positions shown in the depictions D3–E3.

As shown in the depictions A1–E1, the port 164 for the exhaust outlet is correspondingly uncovered (open) in the area between the positions shown in the depictions A1 and E1 (see the depictions B1–D1) and is only covered (closed) in the extreme positions shown in the depictions A1 and E1. The port 163 is, however, exclusively open in the area between the positions shown in the depictions A1 and D1 and is closed in the positions shown in the depictions A1, D1 and E1.

The rocking movement of the pistons 135, 136 makes the pistons sweep the intermediate annular sector of the cavity **110*b* between the spherical portions which are swept by the movement of rotation of the pistons 137, 138**.

The port 162 cooperates with two corresponding recesses **162*a* and 162*b* (see also FIG. 16*a*) in one piston-forming end portion of the first rotor part. More precisely, the recesses extend partly in the piston surface itself and partly in the spherical end surface. The port 162 is therefore guided directly by the circumferential edges of the recesses 162*a*, 162*b* in the spherical end surface of the first rotor part, i.e. the port 162 is guided by a valve body which is formed of the actual piston 137 shown at the recesses 162*a*, 162*b*. The opening of the other ports 161, 163 and 164** is however guided by the circumferential edge of the respective spherical end surface of the first rotor part.

As appears from the depictions A1 and A3, the pistons 137, 138 are larger in the longitudinal direction than in the transverse direction. This is used to carry out the necessary guiding of the ports 161–164. In the depictions A1–A3 and E1–E3, i.e. in the 0°, 180° and 380° positions, all ports are covered by the pistons 137, 138. In the depictions B1–B3, large parts of the ports 161, 163, 164 are, correspondingly, uncovered towards the respective three working chambers, whereas in the depictions C1–C3, the entire ports 161, 163, 164 are uncovered towards the respective three working chambers. In the depictions D1–D3 however, the ports 161, 164 are partly covered, while the port 163 (and the port 162) are completely covered by the pistons 137 and 138, respectively. Between the position D1–D3 and the position E1–D3 (45° angle of rotation), the port 162 is, as mentioned above, uncovered.

More precisely, both the intake port 161 and the exhaust port 164 are kept more or less open through a 180° angle of rotation of the rotor assembly (only covered a small angle in the 0°, 180° and 360° positions). The ports 161, 164 are completely closed only in the 0°, 180° and 360° positions. This means that an optimal opening time for the ports 161, 164 can be obtained, and additionally, optimally large openings of the ports 161, 164 are used.

The port 162 from the engine cavity **110*b* to the combustion chamber 150 has, however, a reduced cross-sectional area in relation to the port 161 and is kept wholly or partly open through a substantially smaller angle of rotation (45° of 180° angle of rotation) as compared to the port 161**.

However, the port 163 is kept open through a slightly larger angle of rotation (135° of 180° angle of rotation) and has a larger cross-sectional area than the port 162. The port 163 opens only after the port 162 is closed, and vice versa.

As appears from what has been said above, each working chamber 131–134 is in turn and each separately connected to the various ports 161, 162 and 163, 164, respectively, i.e. at fixed points of time the four working chambers 131–134 each take a different position which corresponds to the respective one pair of the four strokes of the engine:

1) suction stroke and 2) compression stroke and, respectively:

3) combustion stroke and 4) exhaust stroke.

By arranging the connecting chamber 150 outside the spherical inner cavity of the engine (i.e. radially outside said four working chambers), the respective working chambers are allowed to successively communicate with the connecting chamber once during each 360° rotation cycle.

From a starting point in the 0° position in which a first compression chamber has passed the first stroke, i.e. suction stroke 1 (180° rotation in stroke 1 from the 180° position to the 360° position, i.e. in the present case from a point starting from the 0° position), said first compression chamber is subjected to the compression stroke (stroke 2) and upon a further 135° rotation to the 135° position, said first compression chamber communicates with the connecting chamber 150 through the remaining 45° angle of rotation to the 180° position.

In the 180° position, the connecting chamber 150 then communicates, through the following 135° angle of rotation, with a first working chamber in the expansion stroke (stroke 3) towards the 325° position. In the remaining 45° stroke of the expansion stroke towards the 360° position, the connection between the first working chamber and the connecting chamber 150 is closed. Finally exhaust is discharged through the following 180° angle of rotation (stroke 4, i.e. exhaust stroke).

While the first compression chamber and the first expansion chamber are subjected to strokes 1–4, the second compression chamber and the second expansion chamber are subjected to corresponding strokes with an angular delay of 180° in relation to that above stated.

It is obvious from that mentioned above that the connecting chamber 150 through 180° rotation communicates initially with a first compression chamber and then with a first expansion chamber separately through each separate angle of rotation (45° and, respectively, 135°). Through the following 180° angle of rotation, the connecting chamber then correspondingly communicates first (45°) with the second compression chamber and subsequently (135°) with the second expansion chamber.

It is to be noted that the stated angles and angular positions are stated herein as illustrating examples, but that in practice also other angles and other angular positions may be suitable. A regulation thereof is obtainable by changing the form and location of the ports in relation to the rotor part 124.

By feeding compressed air to the connecting chamber 150 at a compression ratio of say 1/12 simultaneously as fuel is supplied and the mixture thereof is ignited, said connecting chamber is acting as a combustion chamber. As soon as the combustion chamber is closed from the compression chamber (say in the 180° position), the connection from the combustion chamber to the expansion chamber is established and the driving force is transmitted to the expansion chamber through an angle of rotation of 135° towards the 315° position. Through the remaining 45° of the rotation towards the 360° position, the transmission of driving force ceases such that the expansion chamber then (in the 360° position) is connected with the exhaust outlet and most of the driving force is utilised in the expansion chamber.

I claim:

1. A power conversion machine comprising a housing defining a spherical cavity;

a stator secured in said housing on a first axis disposed radially of said cavity, said stator having an annular groove disposed in a plane at an inclined angle to said axis;

an annular guide manner slidably mounted in said groove for rotation about a second axis at an inclined angle to said first axis;

a shaft rotatably mounted on said stator and extending from said cavity;

a first rotor part secured to said shaft for rotation therewith, said rotor part having a first pair of pistons defining ball shaped segments within said cavity of said housing for rotation about said first axis;

a second rotor part having a second pair of pistons defining a pair of ball shaped segments within said cavity of said housing, said second rotor part being disposed on a second axis perpendicular to said first axis with each piston thereof disposed on an opposite side of said first rotor part to define a chamber therebetween; and pin means securing said second rotor part to said annular guide member for rocking of said second rotor part about said second axis during rotation of said first rotor part about said first axis.

2. A machine as set forth in claim 1 wherein said first rotor part has a hub portion between said pistons thereof and on said second axis and said second rotor part has a hub portion between said pistons thereof and on said second axis.

3. Power conversion machine comprising a rotor assembly having a first rotor part (124) with a first pair of pistons (19, 20; 137, 138) and a second rotor part (125) with a second pair of pistons (33, 34; 135, 136) adapted to be moved in a spherical cavity (**10*b*, 110*b*) in the machine housing (10, 110), pairwise and positively in a rocking movement back and forth in relation to said first pair of pistons, said first rotor part (19–21; 124) being connected to a driving or driven rotary shaft (17, 117) while said second rotor part (33–35; 125) is non-rotatably connected to said first rotor part (19–21; 124) so as to perform a conjoint movement of rotation about the axis of rotation (17***a*, 117*a*) of said rotary shaft (17, 117), said first rotor part being rotatable in a first path of revolution in a plane at right angles to said axis of rotation while said second rotor part is rotatable together with and rockable in relation to said first rotor part, and said second rotor part being guided by a guide member (38, 119) rotatable in a second path of revolution inclined by means of stationary guide means (16, 116) at an angle v in relation to said first path of revolution, characterised in that said first and said second rotor part (19–21, 33–35; 124, 125) are defined inwardly of a common spherical generatrix corresponding to a spherical inner side surface in said machine housing (10, 110), and that said stationary guide means (16, 116), for guiding said second rotor part (33, 35; 125) in said rocking movement back and forth, is arranged centrally within the rotor assembly as an elongate stator one end of which is rigidly connected to the machine housing (10, 110).

4. The machine as claimed in claim 3, characterised in that said stationary guide means (16, 116) is arranged coaxially with said rotary shaft (17, 117) and extends through the machine housing from a bearing connecting with the inner end of said rotary shaft (17, 117) to a stationary mounting in the opposite end of said machine housing (10, 110).

5. The machine as claimed in claim 3 or 4, characterised in that said stationary guide means (16, 116) consists of a shaft member which is formed with two stem-shaped end portions (16*b*, 16*c*; 116*c*, 116*e*) on opposite sides of a substantially ball-shaped intermediate portion (16*d*, 116*g*), and that the intermediate portion (16*d*, 116*g*) is provided with an annular guiding groove (41, 118) for receiving said guide member (guide ring 38, 119) which is rotatably mounted in said guiding groove and by means of pins (38, 39; 120*a*, 120*b*) and associated bores or like connecting means is connected to the second rotor part (33–35; 125).

6. The machine as claimed in any one of claims 3 or 4, characterised in that said stationary guide means (16, 116) extends through the center of the first rotor part (19–21; 124), said first rotor part being rotatably mounted in relation to said stationary guide means (16, 116) at the opposite ends thereof.

7. The machine as claimed in any one of claims 3 or 4, characterised in that said first rotor part (124) is passed endwise through said second rotor part (125) through an annular, radially outer rotor part portion (125*a*'', 135, 125*b*'', 136), said first (124) and said second (125) rotor part jointly defining a lubricant receiving space which is sealed against the working chambers (131–134) and encloses said stationary guide means (116) and the associated guide member (119) and the connecting means (121) thereof to the second rotor part (125).

8. The machine as claimed in any one of claims 3 or 4, characterised in that said first rotor part (124) which is in the form of a two-piece hollow body (124*a*, 124*b*) forming a casing and provided with the first pair of exclusively rotating pistons (137, 138), and which is rigidly connected to the rotary shaft (117), is enclosed locally by said second rotor part (125) which is in the form of two annular members (125*a*, 125*b*) and provided with the second pair of pistons (135, 136) which both rotate and rock back and forth, and an intermediate transverse connecting means (121) connecting the annular members with said stationary guide means (116) via the rotatable guide ring (119), and that said two rotor parts (124, 125) jointly define in a fluid-tight and preferably also gas-tight manner the working chambers (131–134) of the machine housing from the transverse connecting means (121) and said stationary guide means (116) positioned inwardly thereof and the associated guide ring (119).

9. The machine as claimed in any one of claims 3 or 4, characterised in that said first rotor part (124) is defined inwardly of a zone forming an intermediate ball sector in the spherical cavity (110*b*) of said machine housing, between two part-spherical portions (125*a*'', 125*b*'') of the annular circumferential portion of said second rotor part (125), the two opposite, piston-forming portions (135, 136) of said second rotor part (125) forming outer, circumferential connecting means between the part-spherical portions (125*a*'', 125*b*'') of said second rotor part, in the area between the axial end portions (137, 138) of said first rotor part (124).

10. The machine as claimed in claim 9, characterised in that said first rotor part (124), in the axial direction in relation to the axis of rotation (117*a*), has a sleeve-forming intermediate portion and two mutually opposite, ball-segment-shaped end portions (137, 138) with cut-off ends, said end portions jointly defining said working chambers (131–134) in the space between the part-spherical ring portions (125*a*'', 125*b*'') of said second rotor part (125) and the outer, piston-forming connecting means (135, 136) which are annularly connected to said part-spherical ring portions.

11. The machine as claimed in any one of claim 10, characterised in that said second rotor part (125) is hingedly connected to the guide member (119) which is rotatably mounted on said stationary guide means (116), by means of a central and radially inner connecting means (121) which is passed transversely through the intermediate portion of said first rotor part (124) in a cavity between the first rotor part (124) and said stationary guide means (116) and the associated guide member (119).

12. The machine as claimed in claim 11, characterised in that said machine housing (110) is, at each of its opposite ends, provided with a pair of ports (161, 164; 162, 163) which are spaced apart in respect of the angle of rotation, said ports being located inwardly of the paths of movement of the circumferential edges of the spherical outer surface of the respective one of the end portions (137, 138) of said first rotor part (124) and being adapted to be covered and uncovered by said end portions (137, 138) in the different positions of rotation or areas of rotation of said rotor assembly, said spherical outer surface which is defined on the end portions (137, 138) of said first rotor part (124) and which is symmetrical with the axis of rotation (117*a*) of the rotor assembly, having a significantly larger length than width.

13. The machine as claimed in claim 12, the machine being in the form of a pump, compressor, two-stroke internal combustion engine or like two-stroke engine, characterised in that the cavity (110*b*) of said engine housing (110) defines, by means of the rotor assembly (124, 125), four separate working chambers (131–134) which are each separately and in turn pairwise subjected to the two strokes of the engine twice per revolution of the rotary assembly in communication with the respective pair of the four ports (161, 163; 162, 164)

of which a first port (161) and a third port (163) constitute at the same time the intake port of a first and, respectively, a third working chamber, while a second port (162) and a fourth port (164) constitute the exhaust port of a third and, respectively, a fourth, working chamber.

14. The machine as claimed in claim 12, the machine being in the form of a four-stroke internal combustion engine characterised in that the cavity (110*b*) of said engine housing (110) defines, by means of the rotor assembly (124, 125), four separate working chambers (131–134) which each separately and in turn pairwise are subjected to the respective two strokes of the four strokes of the engine in communication with the respective port of the two pair of ports (161, 64; 162, 163), of which a first port (161) at the same time constitutes the intake port of a first working chamber, and a second port (162) constitutes the exhaust port for compressed air from a second working chamber to a connecting chamber (150) positioned radially outside the working chambers, a third port (163) constituting the intake port from the connecting chamber (150) to a third working chamber forming the expansion chamber, while a fourth port (164) constitutes the exhaust port from a fourth working chamber to the exhaust outlet.

15. The engine as claimed in claim 14, characterised in that the communication chamber (150) which preferably is arranged outside the cooling casing (106) of the engine, forms an outer combustion chamber with associated fuel nozzle(s) (150*d*, 150*e*) and an igniting means (150*f*'), the combustion chamber (150) preferably being formed of a hollow body (150*a*) which is spaced-apart from the engine housing (110) and the cooling casing (106).

16. The engine as claimed in claim 12, characterised in that said combustion chamber (150) is provided with an inner layer of heat-resistant, ceramic material and preferably a further layer of heat-insulating, ceramic material.

* * * * *